US012759833B2

(12) United States Patent
Ito et al.

(10) Patent No.: US 12,759,833 B2
(45) Date of Patent: Oct. 13, 2026

(54) TAPE MATERIAL CONTROL APPARATUS, METHOD FOR CONTROLLING TAPE MATERIAL CONTROL APPARATUS, METHOD FOR MANUFACTURING PRODUCT, AND RECORDING MEDIUM

(71) Applicant: CANON KABUSHIKI KAISHA, Tokyo (JP)

(72) Inventors: Koji Ito, Kanagawa (JP); Tomoyuki Kubota, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 111 days.

(21) Appl. No.: 18/634,530

(22) Filed: Apr. 12, 2024

(65) Prior Publication Data

US 2024/0359941 A1 Oct. 31, 2024

(30) Foreign Application Priority Data

Apr. 27, 2023 (JP) ..... 2023-072835
Mar. 21, 2024 (JP) ..... 2024-045553

(51) Int. Cl.
*B65H 35/00* (2006.01)

(52) U.S. Cl.
CPC ..... *B65H 35/0086* (2013.01); *B65H 35/0013* (2013.01)

(58) Field of Classification Search
CPC ..... B65H 35/0013; B65H 35/0086
See application file for complete search history.

(56) References Cited

U.S. PATENT DOCUMENTS 6,852,186 B1 * 2/2005 Matsuda ..... B65H 37/002 156/556
10,562,285 B2 2/2020 Koshio et al.
11,462,434 B2 10/2022 Yoshimura
(Continued)

FOREIGN PATENT DOCUMENTS

JP H01-209251 A 8/1989
JP H01-271222 A 10/1989
JP H11268863 A 10/1999
(Continued)

OTHER PUBLICATIONS

Machine translation of WO_2015045646 (Year: 2015).*
Office Action dated Nov. 11, 2025, in Japanese Patent Application No. 2024-045553.

*Primary Examiner* — Vishal I Patel
(74) *Attorney, Agent, or Firm* — Venable LLP

(57) ABSTRACT

A tape material control apparatus includes a supply portion configured to supply a tape material including a peeling member and a sticker member, a first roller configured to feed the tape material to a peeling position where the sticker member is peeled off from the peeling member, a first rotary driving portion, a second roller configured to convey the peeling member from which the sticker member has been peeled off at the peeling position, a second rotary driving portion, a third roller around which the sticker member peeled off at the peeling position is windable, a third rotary driving portion, and a controller is configured to individually control a feeding speed of the tape material by the first rotary driving portion, a conveyance speed of the peeling member by the second rotary driving portion, and a winding speed of the sticker member by the third rotary driving portion.

12 Claims, 23 Drawing Sheets

(56) References Cited

U.S. PATENT DOCUMENTS

| | | | | |
|---|---|---|---|---|
| 2016/0214415 | A1 | 7/2016 | Kawai | |
| 2019/0232629 | A1 * | 8/2019 | Koshio | B32B 38/1858 |

FOREIGN PATENT DOCUMENTS

| | | | | |
|---|---|---|---|---|
| JP | 2010-23131 | A | 2/2010 | |
| JP | 2012-176780 | A | 9/2012 | |
| JP | 2016-135553 | A | 7/2016 | |
| JP | 2018-066841 | A | 4/2018 | |
| JP | 2020-47767 | A | 3/2020 | |
| JP | 2021-59446 | A | 4/2021 | |
| JP | 2022065833 | A | 4/2022 | |
| JP | 2022-94451 | A | 6/2022 | |
| WO | WO-2015045646 | A1 * | 4/2015 | B65C 9/1865 |

* cited by examiner

TAPE MATERIAL CONTROL APPARATUS, METHOD FOR CONTROLLING TAPE MATERIAL CONTROL APPARATUS, METHOD FOR MANUFACTURING PRODUCT, AND RECORDING MEDIUM

BACKGROUND OF THE INVENTION

Field of the Invention

The present disclosure relates to a tape material control apparatus, a method for controlling a tape material control apparatus, a method for manufacturing a product, and a recording medium.

Description of the Related Art

Conventionally, it is common that a work of sticking a sticker member to a workpiece is performed by a skilled worker, but automation is desired for sticking a sticker member with high precision and at a high speed. Therefore, an apparatus for sticking a sticker member to a workpiece has been developed. Further, for the apparatus that performs such sticking, the sticker member needs to be peeled off from a tape material constituted by a peeling member and the sticker member, and the sticker member needs to be supplied to the apparatus that performs the sticking. Automation of this is also desired.

Therefore, in Japanese Patent Application Laid-Open No. 2022-65833, a technique of supplying a tape material body to a reel by setting the tape material in a tool, rotating the reel provided at a distal end of a robot while moving the reel along the tool, and thus winding the tape material body around the reel while peeling off the tape material body from peeling paper is proposed.

In addition, in Japanese Patent Application Laid-Open No. 2020-47767, a technique of supplying an adhesive tape material from a supply reel to a peeling unit, sticking the adhesive tape material to a protective sheet temporarily attached to a sticking target surface by the peeling unit, and peeling off the protective sheet from the sticking target surface while moving the peeling unit is also proposed.

SUMMARY OF THE INVENTION

According to a first aspect of the present invention, a tape material control apparatus includes a supply portion configured to supply a tape material including a peeling member and a sticker member capable of being peeled off from the peeling member, a first roller configured to feed the tape material supplied from the supply portion to a peeling position where the sticker member is peeled off from the peeling member, a first rotary driving portion configured to rotate the first roller, a second roller configured to convey the peeling member from which the sticker member has been peeled off at the peeling position, a second rotary driving portion configured to rotate the second roller, a third roller around which the sticker member peeled off at the peeling position is windable, a third rotary driving portion configured to rotate the third roller, and a controller is configured to individually control a feeding speed of the tape material by the first rotary driving portion, a conveyance speed of the peeling member by the second rotary driving portion, and a winding speed of the sticker member by the third rotary driving portion.

According to a second aspect of the present invention, a method for controlling a tape material control apparatus, includes providing the tape material control apparatus including a supply portion configured to supply a tape material including a peeling member and a sticker member capable of being peeled off from the peeling member, a first roller configured to feed the tape material supplied from the supply portion to a peeling position where the sticker member is peeled off from the peeling member, a first rotary driving portion configured to rotate the first roller, a second roller configured to convey the peeling member from which the sticker member has been peeled off at the peeling position, a second rotary driving portion configured to rotate the second roller, a third roller around which the sticker member peeled off at the peeling position is windable, a third rotary driving portion configured to rotate the third roller, and a controller, and individually controlling, by the controller, a feeding speed of the tape material by the first rotary driving portion, a conveyance speed of the peeling member by the second rotary driving portion, and a winding speed of the sticker member by the third rotary driving portion.

According to a third aspect of the present invention, a tape material control apparatus includes a supply portion configured to supply a tape material including a peeling member and a sticker member capable of being peeled off from the peeling member, a cutting unit including a cutting blade configured to cut the sticker member and a suction attraction portion configured to grip the cut sticker member by suction attraction, a first roller configured to feed the tape material supplied from the supply portion to a peeling position where the cut sticker member is peeled off from the peeling member, a first rotary driving portion configured to rotate the first roller, a second roller configured to convey the peeling member from which the cut sticker member has been peeled off at the peeling position, a second rotary driving portion configured to rotate the second roller, a robot configured to move the cutting unit to the peeling position and a sticking position where the cut sticker member is stuck, and a controller configured to individually control a feeding speed of the tape material by the first rotary driving portion and a conveyance speed of the peeling member by the second rotary driving portion.

According to a fourth aspect of the present invention, a method for controlling a tape material control apparatus, includes providing the tape material control apparatus including a supply portion configured to supply a tape material including a peeling member and a sticker member capable of being peeled off from the peeling member, a cutting unit including a cutting blade configured to cut the sticker member and a suction attraction block configured to grip the cut sticker member by suction attraction, a first roller configured to feed the tape material supplied from the supply portion to a peeling position where the cut sticker member is peeled off from the peeling member, a first rotary driving portion configured to rotate the first roller, a second roller configured to convey the peeling member from which the cut sticker member has been peeled off at the peeling position, a second rotary driving portion configured to rotate the second roller, a robot configured to move the cutting unit to the peeling position and a sticking position where the cut sticker member is stuck, and a controller, and individually controlling, by the controller, a feeding speed of the tape material by the first rotary driving portion and a conveyance speed of the peeling member by the second rotary driving portion.

Further features of the present invention will become apparent from the following description of exemplary embodiments with reference to the attached drawings.

DESCRIPTION OF THE EMBODIMENTS

However, according to Japanese Patent Application Laid-Open No. 2022-65833, a tape material body longer than the movable range of the robot cannot be wound around the reel, and thus the length of the tape material body that can be stuck to the workpiece is limited, which leads to low versatility. In addition, according to Japanese Patent Application Laid-Open No. 2020-47767, although the adhesive tape material can be supplied semi-automatically and thus the work load can be reduced, since a configuration in which the peeling unit is moved is employed similarly, the versatility is low.

Therefore, an object of the present invention is to provide a tape material control apparatus, a method for controlling a tape material control apparatus, a method for manufacturing a product, or a recording medium that can improve the versatility.

First Embodiment

A first embodiment according to the present invention will be described with reference to FIGS. 1 to 18.

Schematic Configuration of Tape Material Control Apparatus

Figure 1:
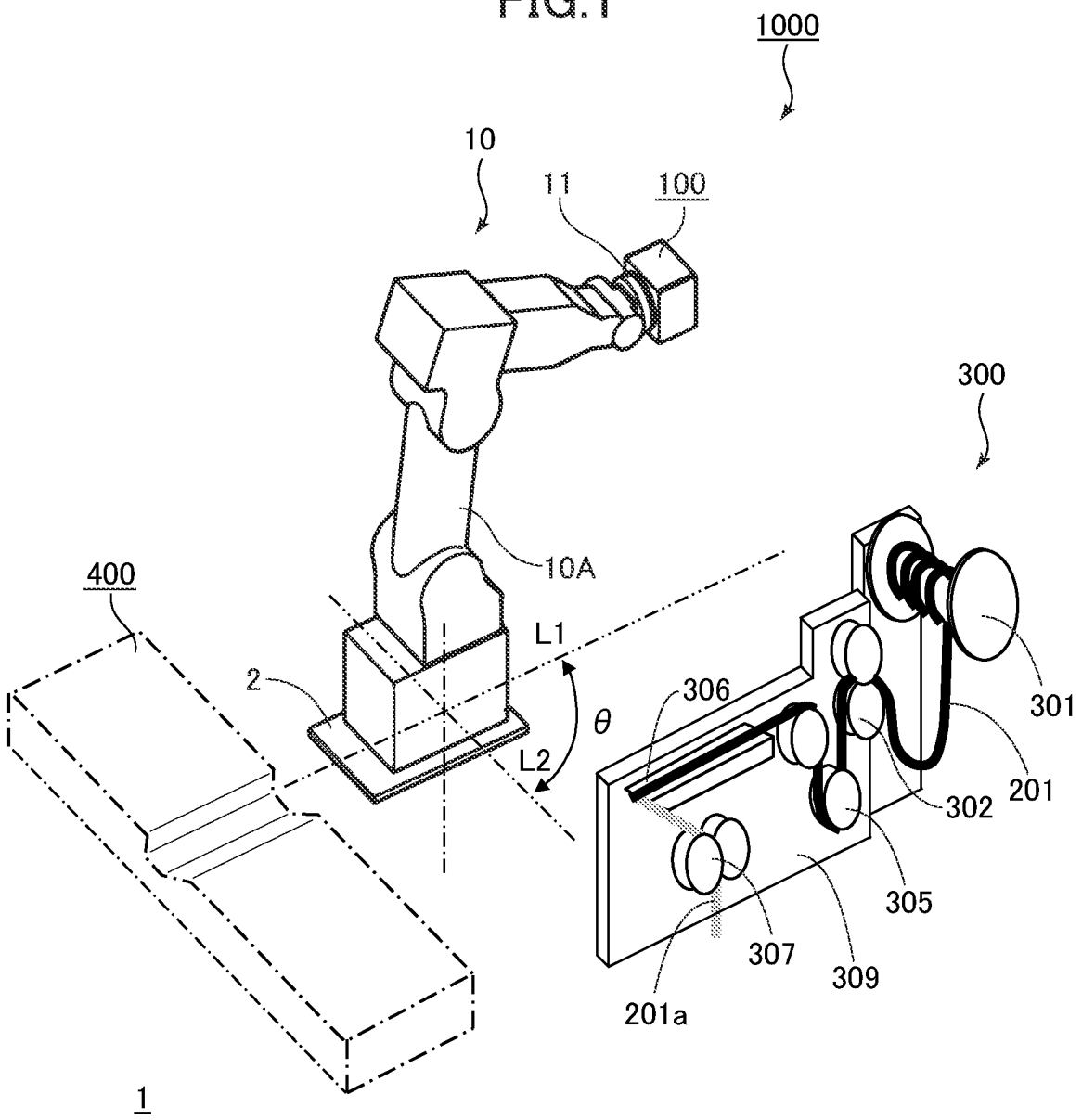
FIG. 1 is a perspective view of a tape material control apparatus according to a first embodiment.

First, a schematic configuration of a tape material control apparatus according to the first embodiment will be described with reference to FIGS. 1 and 2. FIG. 1 is a perspective view of a tape material control apparatus according to the first embodiment. In addition, FIG. 2 is a side view of a sticker part according to the first embodiment.

As illustrated in FIG. 1, for example, a tape material control apparatus 1000 constituted by a robot apparatus 10, a sticker material supply apparatus 300 serving as a supply apparatus, and a workpiece 400 is disposed on an upper surface of a base 1 installed in a factory or the like. Among these, the robot apparatus 10 includes a pedestal 2, and a robot arm 10A serving as a robot body that is a manipulator of a six-axis articulated robot supported by the pedestal 2. A flange portion 11 having a flange shape to which a peeling sticking head 100 serving as an end effector can be attached is provided at a distal end of the robot arm 10A. To be noted, for the control of the six-axis articulated robot, known means can be used, and therefore detailed description thereof will be omitted.

In addition, the sticker material supply apparatus 300 that peels and cuts off a flexible sticker part (hereinafter referred to as a "sticker part") 202 from a tape material 201 having a string shape or a belt shape and supplies the sticker part 202 to the robot apparatus 10 is disposed in the vicinity of the robot apparatus 10. Further, the workpiece 400 serving as a target object to which the sticker part 202 is to be stuck is disposed in the vicinity of the robot apparatus 10 in a direction different from the sticker material supply apparatus 300 as viewed from the robot apparatus 10.

Figure 2:
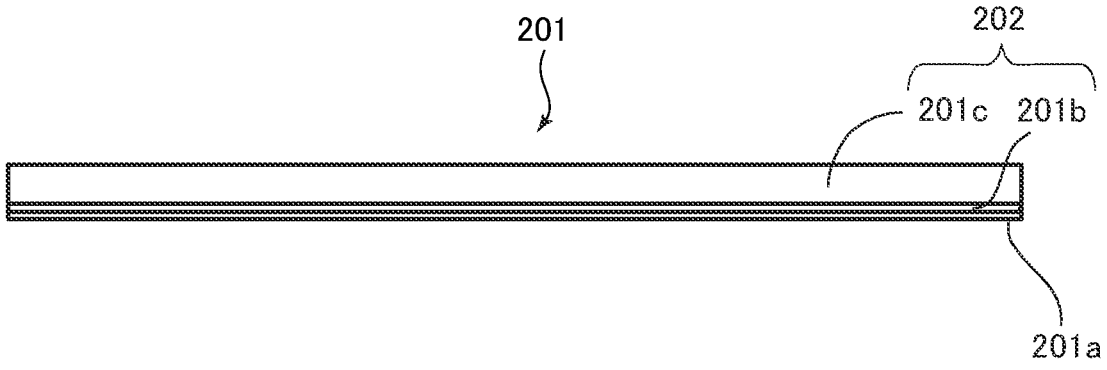
FIG. 2 is a side view of a sticker part according to the first embodiment.

As illustrated in FIG. 2, the tape material 201 is constituted by lamination of a soft material layer 201*c* on peeling paper 201*a* serving as a peeling member with an adhesive layer (sticking layer) 201*b* such as a double-sided tape therebetween. This soft material layer 201*c* is formed from a soft material formed in a sponge shape from a urethane foam or the like. A state in which the adhesive layer 201*b* and the soft material layer 201*c* are peeled off from the peeling paper 201*a* can be defined as a sticker part 202 serving as a sticker member. That is, a configuration in which the sticker part 202 is peelably laminated on the peeling paper 201*a* is employed. In the first embodiment, the tape material 201 is configured to be settable in a supply portion 301 of the sticker material supply apparatus 300 by a manual work, as a supply roll wound up in a bobbin shape. Further, in the sticker material supply apparatus 300 that will be described later, the soft material layer and the adhesive layer of the tape material 201 are cut and peeled off from the peeling paper 201*a*. As a result of this, the sticker part 202 constituted by the adhesive layer 201*b* and the soft material layer 201*c* is supplied to the peeling sticking head 100 of the robot apparatus 10. To be noted, in the description of the first embodiment below, regarding two end portions of the sticker part 202, for the sake of convenience, an end portion on the side on which the sticker part 202 is wound around the peeling sticking head 100 first will be referred to as a leading end, and an end portion on the side on which the sticker part 202 is wound around the peeling sticking head 100 last will be referred to as a trailing end.

In contrast, the workpiece 400 is manually set in a mounting position by unillustrated positioning. The robot apparatus 10 moves the peeling sticking head 100 to a position above a peeling stage 306 serving as a peeling position of the sticker material supply apparatus 300, and performs the winding operation of peeling and winding up the sticker part 202 each time. Then, a sticking operation of conveying and sticking the wound-up sticker part 202 to the workpiece 400 is performed each time. That is, the robot apparatus 10 repeatedly executes the winding operation and the sticking operation, and thus sticks the sticker part 202 to the workpiece 400. By the operation described above, the workpiece 400 to which the sticker part 202 is stuck is manufactured as a product.

The sticker material supply apparatus 300 and the workpiece 400 are respectively disposed on straight lines L1 and L2 forming an angle θ therebetween about a first shaft serving as a rotation shaft of the pedestal 2 within an operable range of the robot apparatus 10. The arrangement of these may be appropriately determined in accordance with the setting status of the sticker material supply apparatus 300 and the workpiece 400, the installation spaces of these, the environment of the surroundings, and the like, but it is preferable that the operable range of the robot apparatus 10 is not widened more than necessary in consideration of the takt time.

Configuration of Sticker Material Supply Apparatus

Figure 3:
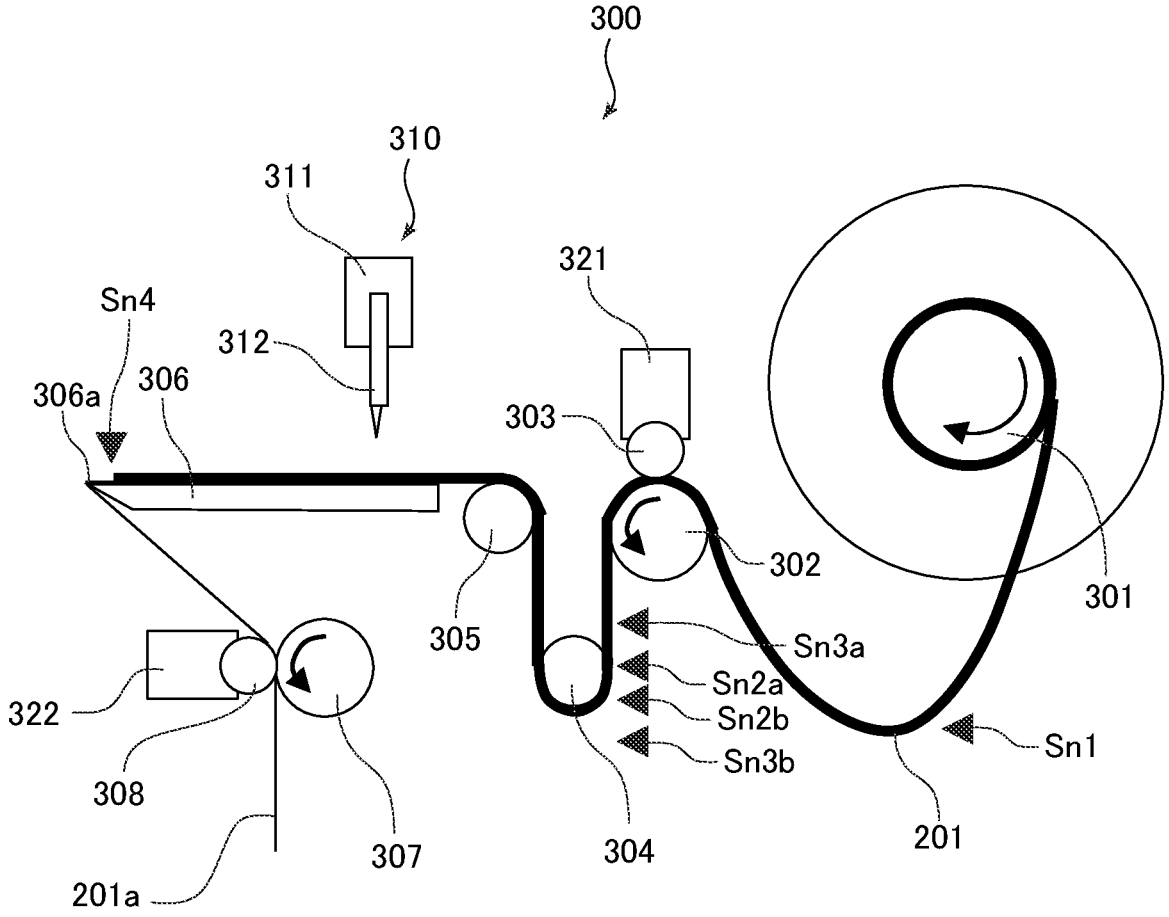
FIG. 3 is a schematic front view of a sticker material supply apparatus according to the first embodiment.

Next, the configuration of the sticker material supply apparatus 300 will be described with reference to FIGS. 1 and 3. FIG. 3 is a schematic front view of a sticker material supply apparatus according to the first embodiment. As illustrated in FIG. 1, the sticker material supply apparatus 300 includes a side plate 309 provided to erect from the base 1. That is, as illustrated in FIGS. 1 and 3, the sticker material supply apparatus 300 includes a supply portion 301, a dancer roller control roller 302 serving as a first roller, a pressing roller 303, and a dancer roller 304 that are supported by the side plate 309. Further, the sticker material supply apparatus 300 includes a stretch roller 305, a sticker cutting portion 310 serving as a cutting portion, a peeling stage 306 serving as a peeling position, a peeling paper feeding roller 307 serving as a second roller, and a pressing roller 308 that are supported by the side plate 309. Further, the sticker material supply apparatus 300 is configured such that the tape material 201 is drawn around via these rollers.

As illustrated in FIG. 3, the supply portion 301 is constituted by setting a supply roll around which the tape material 201 is wound, and the rotational speed thereof is controlled by a motor 301A (see FIG. 8) whose rotation is controlled by a supply portion rotation control portion 521. That is, the supply speed of the supply portion 301 feeding and supplying the tape material 201 by being rotationally driven is controlled by a system controller 500. In addition, the supply portion 301 supplies the tape material 201 such that slack of the tape material 201 occurs between the supply portion 301 and the dancer roller control roller 302. That is, the slack amount of the tape material 201 is detected by a slack detection sensor Sn1 serving as a third detection portion constituted by an optical sensor or the like disposed in a lower portion of the supply portion 301, and the rotation of the supply portion 301 is controlled by the system controller 500 so as to always maintain a constant slack amount.

The rotation speed of the dancer roller control roller 302 is controlled by a motor 302A (see FIG. 8) whose rotation is controlled by a dancer roller control roller control portion 522. That is, the dancer roller control roller 302 is rotated so as to feed the tape material 201 to the dancer roller 304 and the peeling stage 306 serving as the peeling position (supply position of sticker part) that will be described later. In addition, the pressing roller 303 is configured to be capable of pressurization by opening and closing with respect to the dancer roller control roller 302 by an air cylinder 321. The pressing roller 303 is rotated by being driven via the tape material 201 by rotating the dancer roller control roller 302 in a state in which the tape material 201 is clamped between the dancer roller control roller 302 and the pressing roller 303.

The dancer roller 304 is supported so as to be slidable in the up-down direction by a support mechanism whose illustration is omitted, and is urged downward by an unillustrated urging member such as a spring or by the weight thereof. Further, the dancer roller 304 is disposed so as to press the tape material 201 stretched between the dancer roller control roller 302 and the stretch roller 305 from above. To be noted, the stretch roller 305 is configured to rotate by being driven by the tape material 201. The dancer roller 304 configured in this manner is configured to apply a constant tension to the tape material 201 drawn to the sticker material supply apparatus 300. That is, the system controller 500 moves down the dancer roller 304 by feeding the tape material 201 by the rotation of the dancer roller control roller 302, and moves up the dancer roller 304 by conveying the peeling paper 201*a* by the rotation of the peeling paper feeding roller 307. By moving up or down the dancer roller 304 in this manner, the length of the passage path of the tape material between the peeling paper feeding roller 307 and the dancer roller control roller 302 is increased or decreased. Therefore, basically, the tension is applied to the tape material 201 without changing the position of the dancer roller 304, by controlling the peeling paper feeding roller 307 and the dancer roller control roller 302 to the same timing and the same conveyance speed.

To be noted, even if the peeling paper feeding roller 307 and the dancer roller control roller 302 are controlled to the same conveyance speed, the dancer roller 304 moves up or down in the actual operation. Therefore, the sticker material supply apparatus 300 is provided with a dancer roller position detection sensor Sn2 (see FIG. 8) serving as a first detection portion. For example, the dancer roller position detection sensor Sn2 includes an upper position detection sensor Sn2*a* and a lower position detection sensor Sn2*b* as illustrated in FIG. 3. It is assumed that, for example, the upper position detection sensor Sn2*a* has detected upward movement of the dancer roller 304 by a predetermined amount from the original position. In this case, the dancer roller 304 is moved down to be closer to the original position by increasing the feeding speed of the dancer roller control roller 302 such that there is a speed difference between the feeding speed of the dancer roller control roller 302 and the conveyance speed of the peeling paper feeding roller 307. Conversely, it is assumed that, for example, the lower position detection sensor Sn2*b* has detected downward movement of the position of the dancer roller 304 by a predetermined amount from the original position. In this case, the dancer roller 304 is moved up to be closer to the original position by decreasing the feeding speed of the dancer roller control roller 302 such that there is a speed difference between the feeding speed of the dancer roller control roller 302 and the conveyance speed of the peeling paper feeding roller 307.

In addition, there is a possibility that an abnormality such as stoppage of the tape material 201 by slipping or being caught by one of the rollers occurs. Therefore, the sticker material supply apparatus 300 is provided with a dancer roller abnormality detection sensor Sn3 (see FIG. 8) serving as a second detection portion. For example, the dancer roller abnormality detection sensor Sn3 includes an upper abnormality detection sensor Sn3*a* and a lower abnormality detection sensor Sn3*b* as illustrated in FIG. 3. The upper abnormality detection sensor Sn3*a* and the lower abnormality detection sensor Sn3*b* are disposed at positions farther away from the original position in the up-down direction than the upper position detection sensor Sn2*a* and the lower position detection sensor Sn2*b* that are described above. Further, it is assumed that one of the upper abnormality detection sensor Sn3*a* and the lower abnormality detection sensor Sn3*b* has detected movement of the dancer roller 304 thereto. That is, in this case, abnormality is detected and the sticker material supply apparatus 300 is stopped as a case where the position of the dancer roller 304 has moved up or down to an abnormal position beyond a normal movement range (predetermined range) including the original position.

To be noted, although a case where the dancer roller position detection sensor Sn2 and the dancer roller abnormality detection sensor Sn3 are configured as separate sensors has been described in the first embodiment as described above, the configuration is not limited to this, and these may be constituted by a single sensor. The form of the sensor is not limited, and for example, the position of a member that moves together with the dancer roller 304 in a support mechanism (not illustrated) supporting the dancer roller 304 may be detected by an encoder or a laser distance meter.

The sticker cutting portion 310 includes an air cylinder 311 controlled by a cutting blade moving air control portion 531 (see FIG. 8), and a cutting blade 312 moved up and down by the air cylinder 311. The cutting blade 312 stands by in a moved-up state, but moves down at the time of cutting, and cuts off the sticker part 202 (soft material layer 201*c* and adhesive layer 201*b*) serving as a part of the product without cutting the peeling paper 201*a* of the tape material 201. For the cutting blade 312 used for the sticker cutting portion 310, for example, a Thomson blade or an ultrasonic cutter can be used. To be noted, in the first embodiment, a mechanical configuration in which a minute gap between the cutting edge and the peeling stage 306 is constant when the cutting blade 312 is moved down is employed, and the size of the gap is set to about a half of the thickness of the peeling paper 201*a*.

The peeling stage 306 plays a role as a receiving stage for receiving the tape material 201 and a role of promoting the peeling of the sticker part 202 by drawing the peeling paper 201*a* of the tape material 201 around at an acute angle at a leading end portion 306*a* of the peeling stage 306. As will be described in detail later, the peeling stage 306 includes a peeling position for supplying the sticker part 202 to the peeling sticking head 100 while peeling off the sticker part 202 from the peeling paper 201*a*. To be noted, in the first embodiment, when peeling off the sticker part 202, the posture of the peeling sticking head 100 is changed, but the peeling sticking head 100 is not usually moved. However, since there is a distance between a leading end chuck 105 and a trailing end chuck 103 that will be described later, the peeling position (supply position) in the first embodiment has a range of a predetermined length in the conveyance direction of the tape material 201 corresponding to this distance. In addition, a sticker material leading end detection sensor Sn4 serving as a fourth detection portion that detects arrival at a start position of a leading end 202*s* of the sticker part 202 cut off from the tape material 201, the start position being a position where the peeling is started, is disposed above the peeling stage 306.

The rotational speed of the peeling paper feeding roller 307 is controlled by a motor 307A (see FIG. 8) whose rotation is controlled by a peeling paper feeding roller control portion 523. That is, the peeling paper feeding roller 307 is rotated to convey the tape material 201 positioned downstream of the dancer roller 304 in the conveyance direction. In addition, the pressing roller 308 is configured to be capable of pressurization by opening and closing with respect to the peeling paper feeding roller 307 by the air cylinder 322. The pressing roller 308 is rotated by being driven via the peeling paper 201*a* of the tape material 201 by rotating the peeling paper feeding roller 307 in a state in which the peeling paper 201*a* is clamped between the peeling paper feeding roller 307 and the pressing roller 308. To be noted, the peeling paper 201*a* fed by the rotation of the peeling paper feeding roller 307 may be collected into a collecting box or the like as it is, or may be wound up by an unillustrated roller and collected as a roll of a certain amount.

Configuration of Peeling Sticking Head

Figure 4:
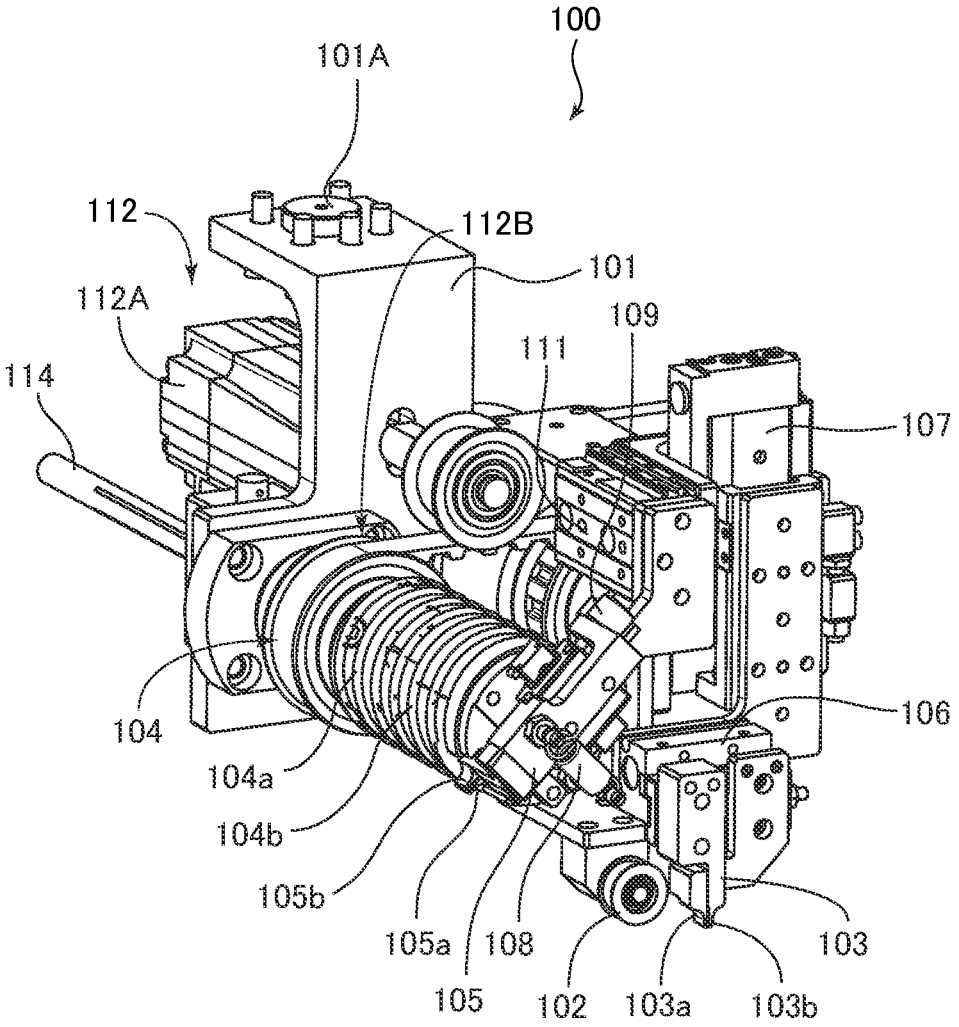
FIG. 4 is a perspective view of a peeling sticking head according to the first embodiment.
Figure 5:
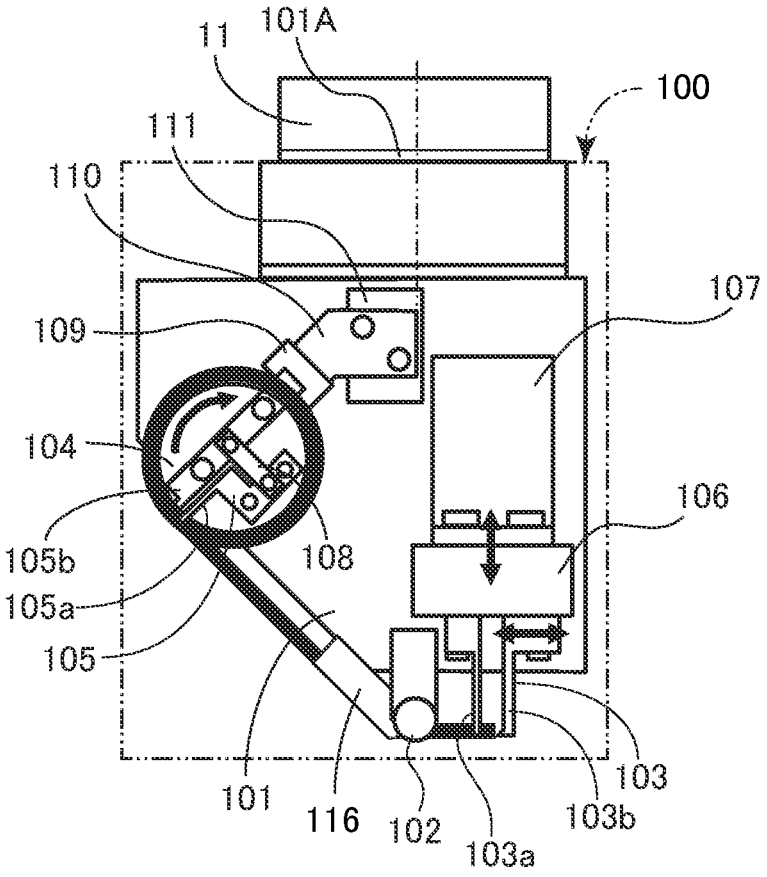
FIG. 5 is a schematic front view of the peeling sticking head according to the first embodiment.
Figure 6:
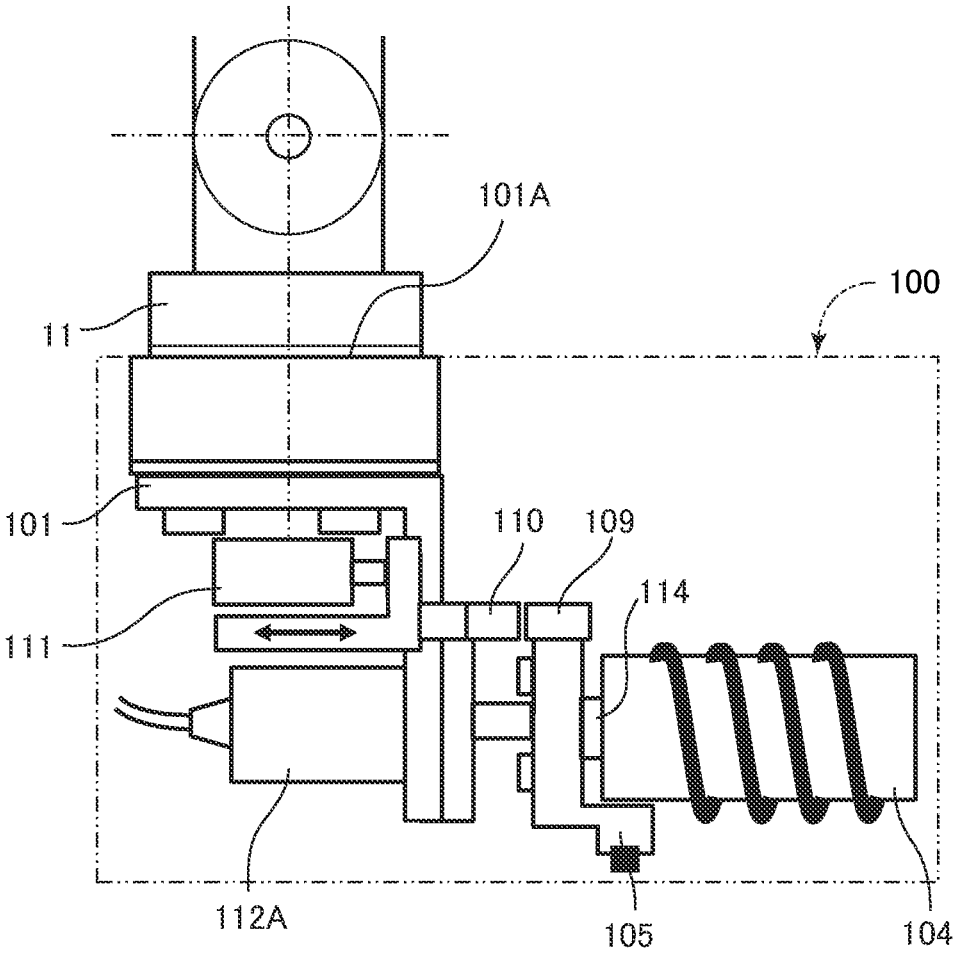
FIG. 6 is a schematic side view of the peeling sticking head according to the first embodiment.
Figure 7:
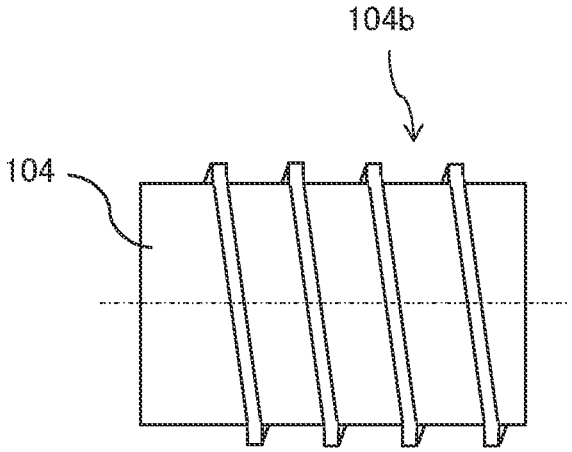
FIG. 7 is a schematic view of a winding roller according to the first embodiment.

Next, the configuration of the peeling sticking head according to the first embodiment will be described with reference to FIGS. 4 to 7. FIG. 4 is a perspective view of the peeling sticking head according to the first embodiment. FIG. 5 is a schematic front view of the peeling sticking head according to the first embodiment. FIG. 6 is a schematic side view of the peeling sticking head according to the first embodiment. FIG. 7 is a schematic view of a winding roller according to the first embodiment.

As illustrated in FIGS. 4, 5, and 6, the peeling sticking head 100 includes an attachment 101, a connecting portion 101A of the attachment 101 is fixed to the flange portion 11 (see FIG. 1) disposed on a sixth shaft of the robot arm 10A of the robot apparatus 10. The attachment 101 rotatably supports a winding roller 104 serving as a third roller to which the leading end chuck 105 serving as a first gripping portion capable of gripping the leading end of the sticker part 202 is integrally fixed. The winding roller 104 has an outer circumferential surface 104*a* around which the sticker part 202 is wound.

In addition, the attachment 101 includes a rotational driving mechanism 112 that rotationally drives the winding roller 104, and a ball spline shaft 114 serving as an axial direction moving portion. The rotational driving mechanism 112 includes a motor 112A that outputs a driving force to rotate the winding roller 104, and a transmission mechanism 112B constituted by a belt-and-pulley mechanism that transmits the rotation of the motor 112A to the ball spline shaft 114. Further, the ball spline shaft 114 slides the winding roller 104 in the axial direction by the rotation of the motor 112A.

As described above, in the configuration of the peeling sticking head 100 according to the first embodiment, the ball spline shaft 114 is used for the sliding of the winding roller 104 in the axial direction. As a result of this, the rotation and the slide movement in the axial direction of the winding roller 104 can be performed in synchronization (that is, in an interlocked manner). In addition, the number of motors is reduced, and thus the cost is reduced. To be noted, a motor that rotationally drives the winding roller 104 and a motor that slides the winding roller 104 in the axial direction may be provided separately, and these may be independently operated.

Meanwhile, the leading end chuck 105 is fixed to the winding roller 104 so as to integrally rotate with the winding roller 104. Specifically, the leading end chuck 105 includes a fixed chuck 105*a* fixed to the winding roller 104, and a movable chuck 105*b* that opens and closes by relatively moving with respect to the fixed chuck 105*a*. The movable chuck 105*b* is urged toward the fixed chuck 105*a* by a tension spring 108 (see FIG. 4), that is, the leading end chuck 105 is always urged in the closing direction by the tension spring 108. Further, an air cylinder 111 that presses the movable chuck 105*b* via a cam follower 109 is attached to the attachment 101.

In addition, as illustrated in FIG. 6, the ball spline shaft 114 is fixed to an end portion of the winding roller 104, and the leading end chuck 105 is fixed to the ball spline shaft 114 with a bolt or the like. In addition, the cam follower 109 is attached to the side opposite to the leading end chuck 105. Further, a configuration in which the leading end portion 110 presses the cam follower 109 by the extension/contraction operation of the air cylinder 111 in the axial direction, and thus the movable chuck 105*b* always in the closed state is opened from the fixed chuck 105*a* against the urging force of the tension spring 108 is employed.

To be noted, if the leading end chuck 105 is opened and closed simply by operating the air cylinder, there is a possibility that the air plumbing is twisted as a result of the air plumbing rotating together with the rotation of the winding roller 104. Therefore, a configuration in which the air cylinder 111 is separated from the leading end chuck 105 is employed as described above, but this configuration does not need to be employed.

Meanwhile, as illustrated in FIGS. 4 and 5, in the peeling sticking head 100, a pressing roller 102 serving as a fourth roller and the trailing end chuck 103 serving as a second gripping portion capable of gripping the trailing end of the sticker part 202 are provided in the state of being attached to the attachment 101. The pressing roller 102 and the trailing end chuck 103 are disposed in a positional relationship parallel to the axial direction of the winding roller 104. The pressing roller 102 is disposed between the winding roller 104 and the trailing end chuck 103 to be adjacent to the trailing end chuck 103, and is rotatably supported with respect to the attachment 101. The pressing roller 102 is configured to abut the sticker part 202 stretched between the winding roller 104 and the trailing end chuck 103 from the inner side, and is particularly configured to be capable of pressing the sticker part 202 against the peeling stage 306 in the winding operation.

In addition, as illustrated in FIG. 5, a position regulating guide 116 serving as a guide for regulating the position of the sticker part 202 may be provided. Although illustration in FIG. 4 is omitted, the position regulating guide 116 is provided in the vicinity of the member on which the pressing roller 102 is provided, so as not to interrupt the rotation of the pressing roller 102 and not to interrupt the winding and sticking of the sticker part 202. The position regulating guide 116 illustrated in FIG. 5 is disposed between the winding roller 104 and the pressing roller 102 so as to be adjacent to the pressing roller 102 (in the vicinity of the pressing roller 102). The position regulating guide 116 is configured to abut the sticker part 202 stretched between the winding roller 104 and the trailing end chuck 103 from the inner side, and is configured to be capable of regulating the position of the sticker part 202 in the short-side direction particularly in the winding operation.

Here, as illustrated in FIG. 5, the position regulating guide 116 is positioned on a common tangent between the pressing roller 102 and the winding roller 104 and comes into contact with a side surface of the stretched sticker part 202, and thus the position of the tape material in the short-side direction can be regulated. In addition, by disposing the position regulating guide 116 as close to the pressing roller 102 as possible, the position regulating effect for the tape material in the short-side direction is improved, and particularly twisting of the tape material can be suppressed when sticking the sticker part 202 to a curved line.

In addition, in the first embodiment, as illustrated in FIG. 7, a holding groove 104*b* having a spiral shape and configured to hold the wound-up sticker part 202 so as not to be displaced particularly in the axial direction is provided in the outer circumferential surface 104*a* of the winding roller 104. To be noted, the winding roller 104 of FIG. 7 is illustrated in a simplified manner for the sake of convenience of description. As a result of this, overlapping and uneven intervals of the sticker part when winding up the sticker part can be suppressed, and the precision of the winding amount and the feeding amount with respect to the rotation amount in the winding operation and the sticking operation can be improved.

Configuration of Control System of Tape Material Control Apparatus

Figure 8:
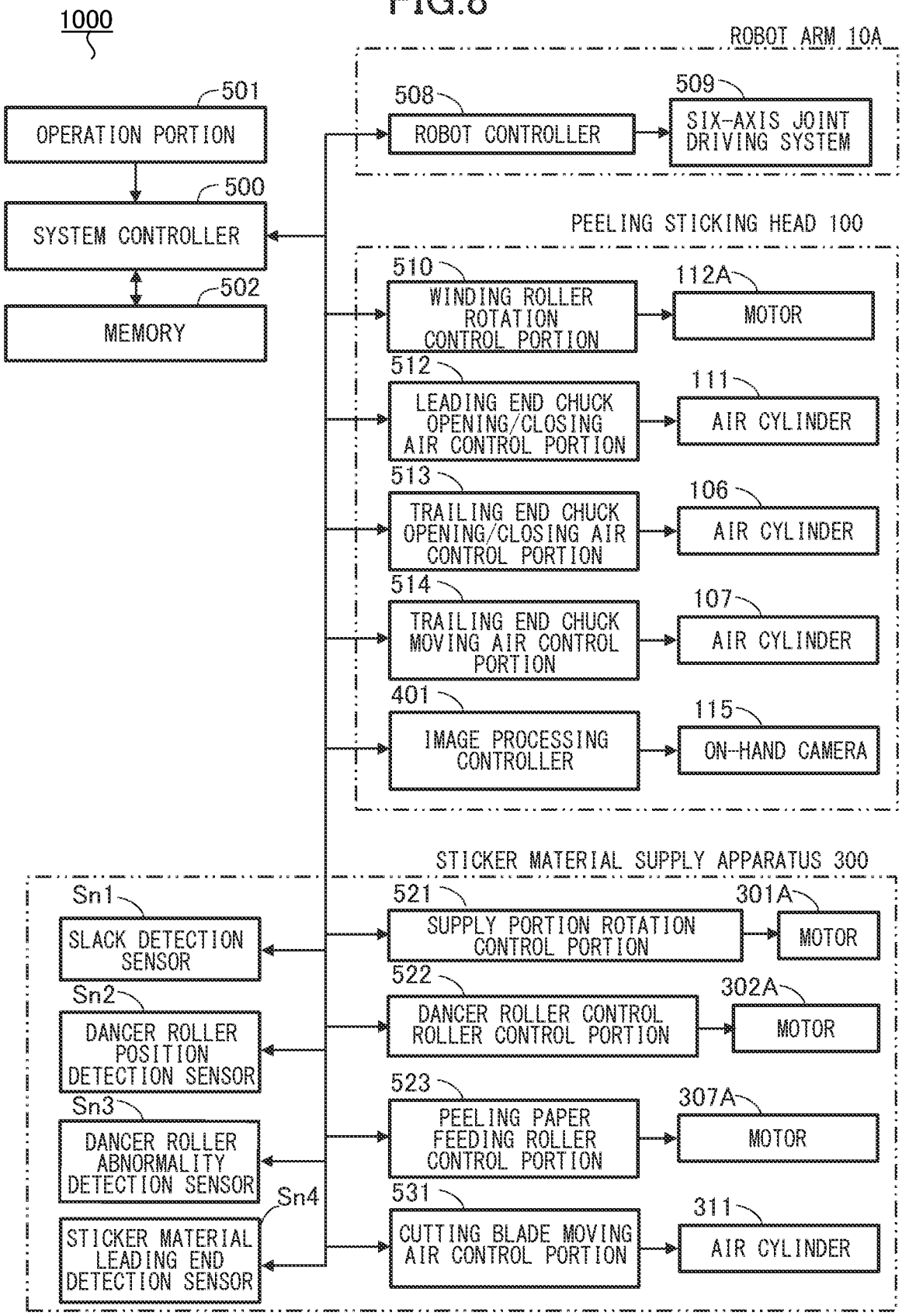
FIG. 8 is a block diagram illustrating a control system of the tape material control apparatus according to the first embodiment.

Next, the configuration of the control system of the tape material control apparatus 1000 will be described with reference to FIG. 8. FIG. 8 is a block diagram illustrating a control system of the tape material control apparatus according to the first embodiment.

The system controller 500 serving as a controller is a so-called central processing unit: CPU, executes a program stored in a memory 502 constituted by a random access memory: RAM, a read-only memory: ROM, and the like in accordance with an operation on an operation portion 501, and thus controls each component of the tape material control apparatus 1000. That is, the system controller 500 integrally controls the robot arm 10A, the peeling sticking head 100, and the sticker material supply apparatus 300. The robot arm 10A includes a six-axis joint driving system 509 constituted by motors driving the joints of the robot arm 10A and the like, and a robot controller 508 that controls the six-axis joint driving system 509 in accordance with a movement target position and a movement path.

To be noted, the program stored in the memory 502 described above may be a program stored in a transitory or non-transitory computer-readable recording medium such as a hard disk, a compact disk, a digital versatile disk, or a flash memory. Further, this program can be referred to as a program to be executed by a computer such as the system controller 500.

Meanwhile, the peeling sticking head 100 includes a winding roller rotation control portion 510 serving as a third rotary driving portion that drives the motor 112A to control the normal rotation or reverse rotation of the winding roller 104 and position of the winding roller 104 in the axial direction, Further, the peeling sticking head 100 includes a leading end chuck opening/closing air control portion 512 that controls the air cylinder 111 that opens and closes the leading end chuck 105 that is always maintained in the closed state by the tension spring 108 described above. In addition, the peeling sticking head 100 includes a trailing end chuck opening/closing air control portion 513 that controls an air cylinder 106 that opens and closes the trailing end chuck 103. In addition, the peeling sticking head 100 includes a trailing chuck moving air control portion 514 that controls an air cylinder 107 for moving up and down the trailing end chuck 103, which drives the trailing end chuck 103 in the up-down direction. Further, the peeling sticking head 100 may include an image processing controller 401 that controls an on-hand camera 115 for obtaining the sticking position on the workpiece 400 and the peeling position (position of the peeling stage 306) in the sticker material supply apparatus 300.

In addition, the sticker material supply apparatus 300 includes a supply portion rotation control portion 521 that drives the motor 301A to control the rotational speed of the supply portion 301 (supply speed of the tape material 201). Further, the sticker material supply apparatus 300 includes a dancer roller control roller control portion 522 serving as a first rotary driving portion that drives the motor 302A to control the rotational speed of the dancer roller control roller 302 (feeding speed of the tape material 201). Further, the sticker material supply apparatus 300 includes a peeling paper feeding roller control portion 523 serving as a second rotary driving portion that drives the motor 307A to control the rotational speed of the peeling paper feeding roller 307 (conveyance speed of the peeling paper 201*a*). In addition, the sticker material supply apparatus 300 includes a cutting blade moving air control portion 531 that drives the air cylinder 311 to control the movement of the cutting blade 312 in the up-down direction. These motors and air cylinders are each simultaneously and independently controlled, and thus driving of the rollers and cutting blades can be controlled in a desired manner. In addition, the sticker material supply apparatus 300 includes the slack detection sensor Sn1, the dancer roller position detection sensor Sn2, the dancer roller abnormality detection sensor Sn3, and the sticker material leading end detection sensor Sn4 described above in connection with the system controller 500.

To be noted, although a case where each controller and each control portion is provided in the robot arm 10A or the peeling sticking head 100 is described in the first embodiment, the configuration is not limited to this, and the controllers and control portions may be disposed on the outside. In this case, the command signals are transmitted wirelessly or through wiring.

Sticker Part Supply Operation

Figure 9:
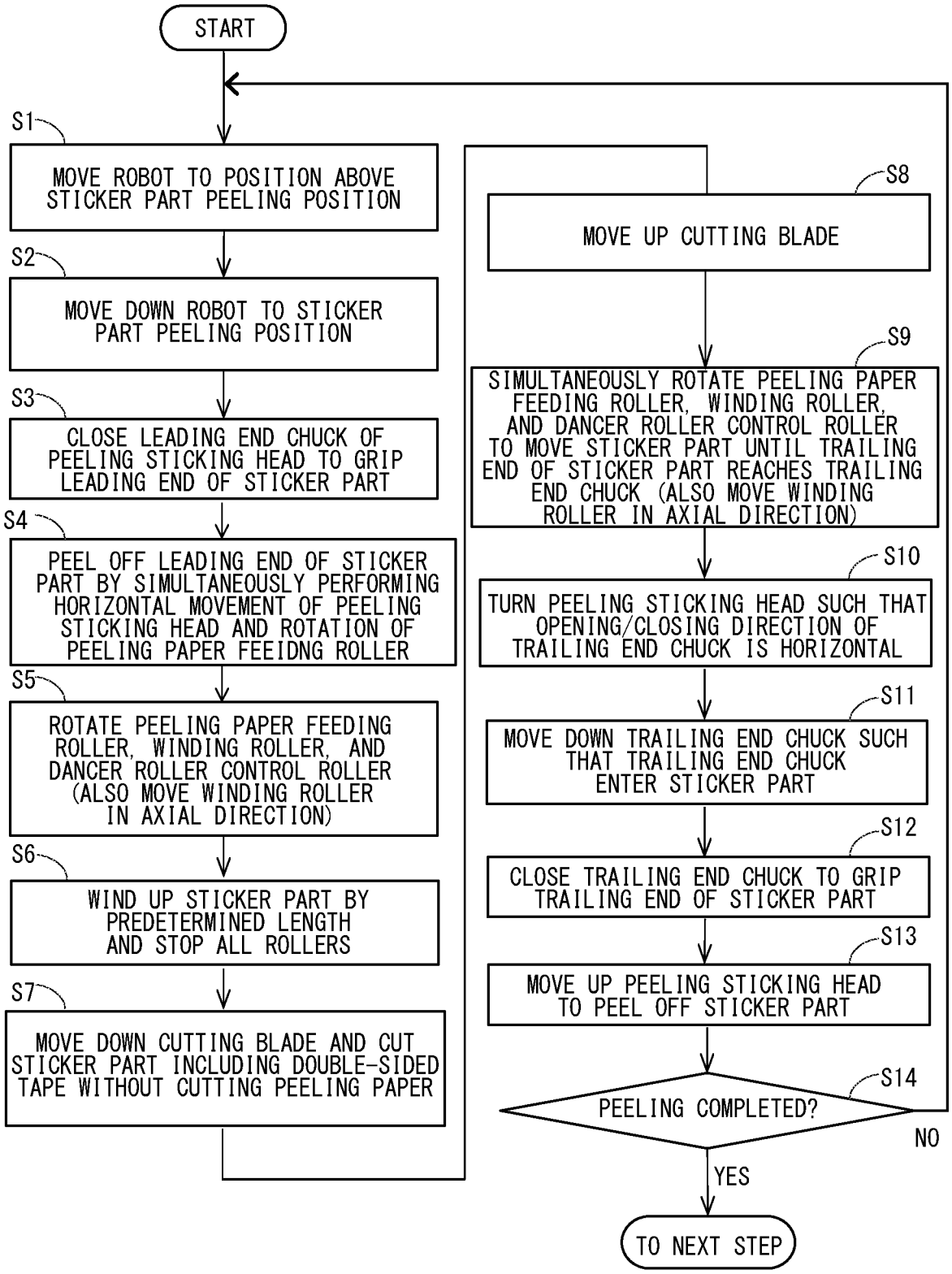
FIG. 9 is a flowchart illustrating a sticker part supply process according to the first embodiment.
Figure 10:
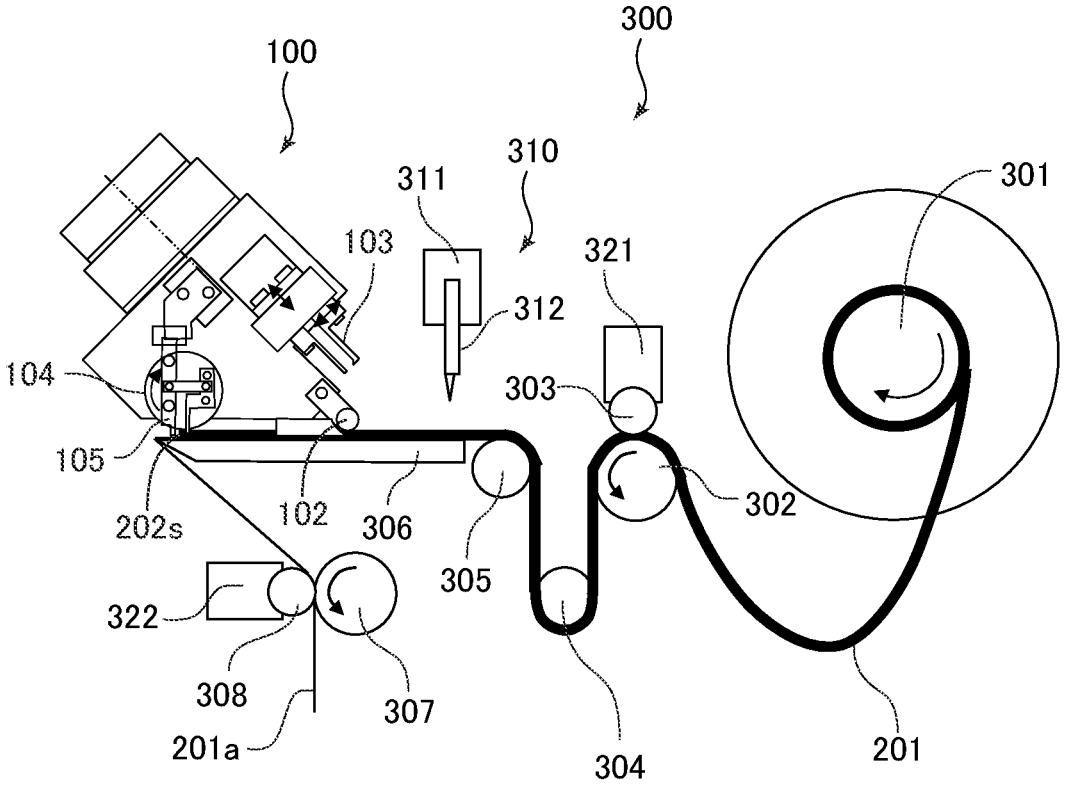
FIG. 10 is a diagram illustrating an operation of gripping a leading end of a sticker part by the peeling sticking head.
Figure 11:
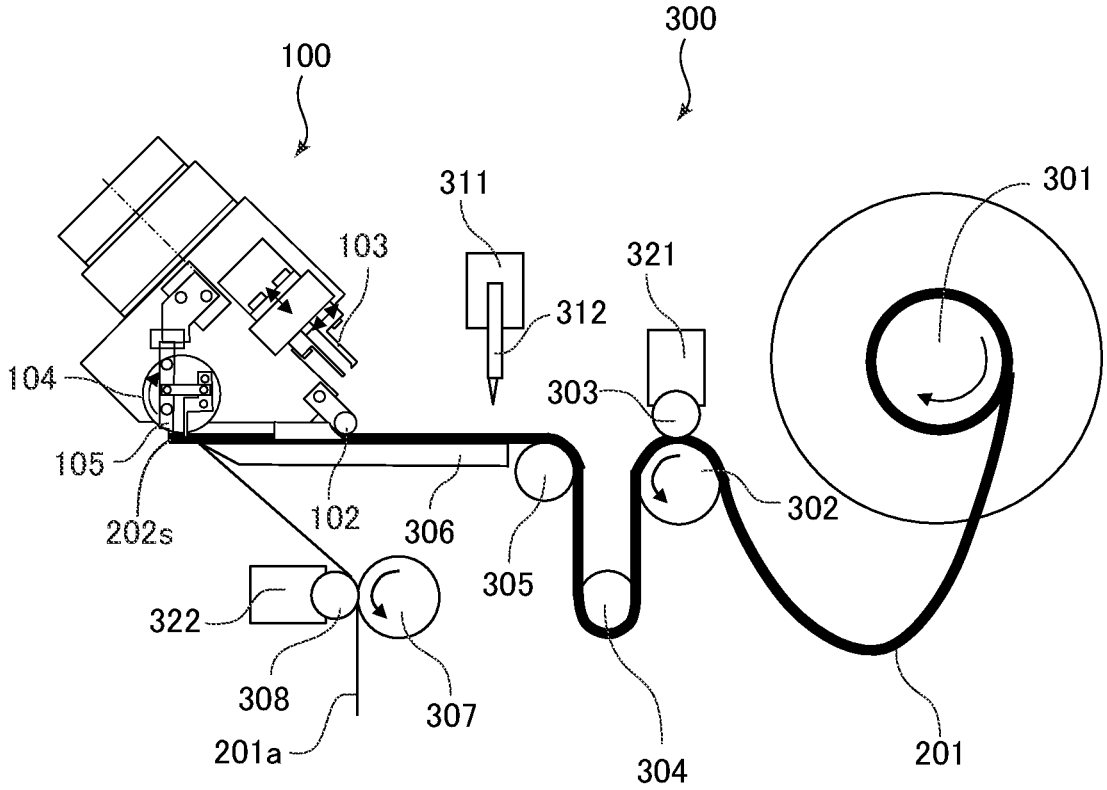
FIG. 11 is a diagram illustrating an operation of peeling off the leading end of the sticker part from peeling paper.
Figure 12:
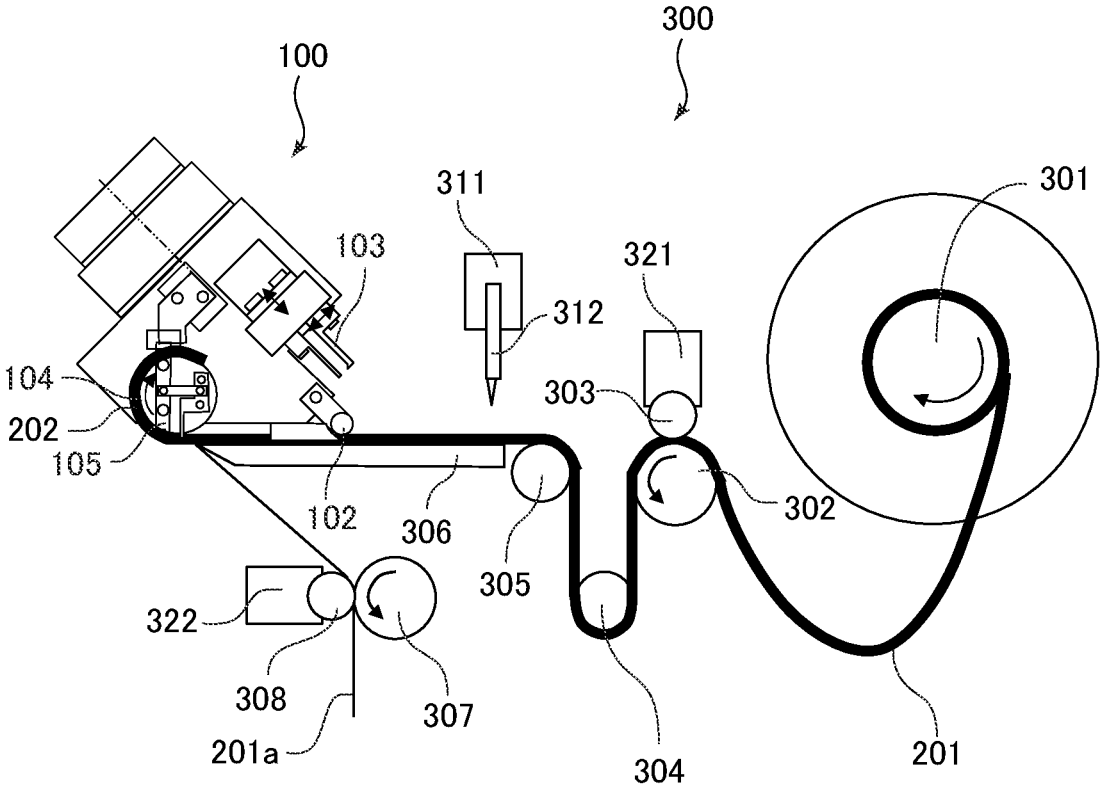
FIG. 12 is a diagram illustrating an operation of peeling off the sticker part from the peeling paper and winding up the sticker part by a winding roller.
Figure 13:
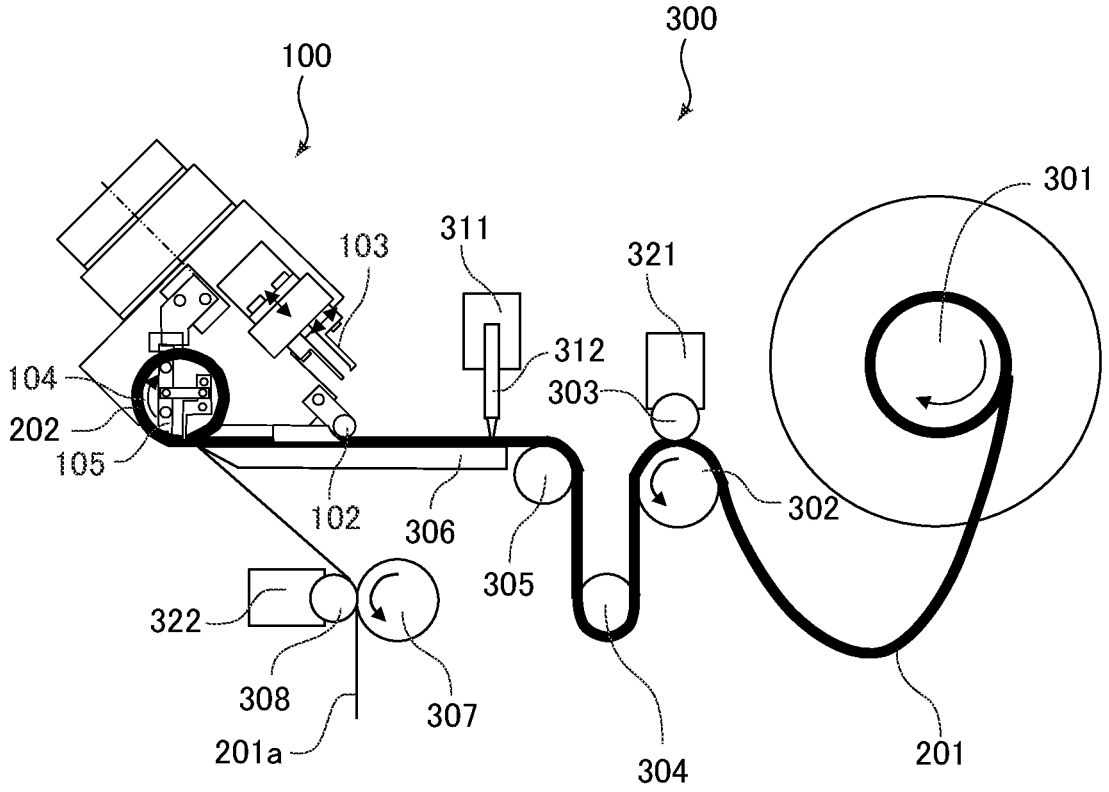
FIG. 13 is a diagram illustrating an operation of cutting the sticker part.
Figure 14:
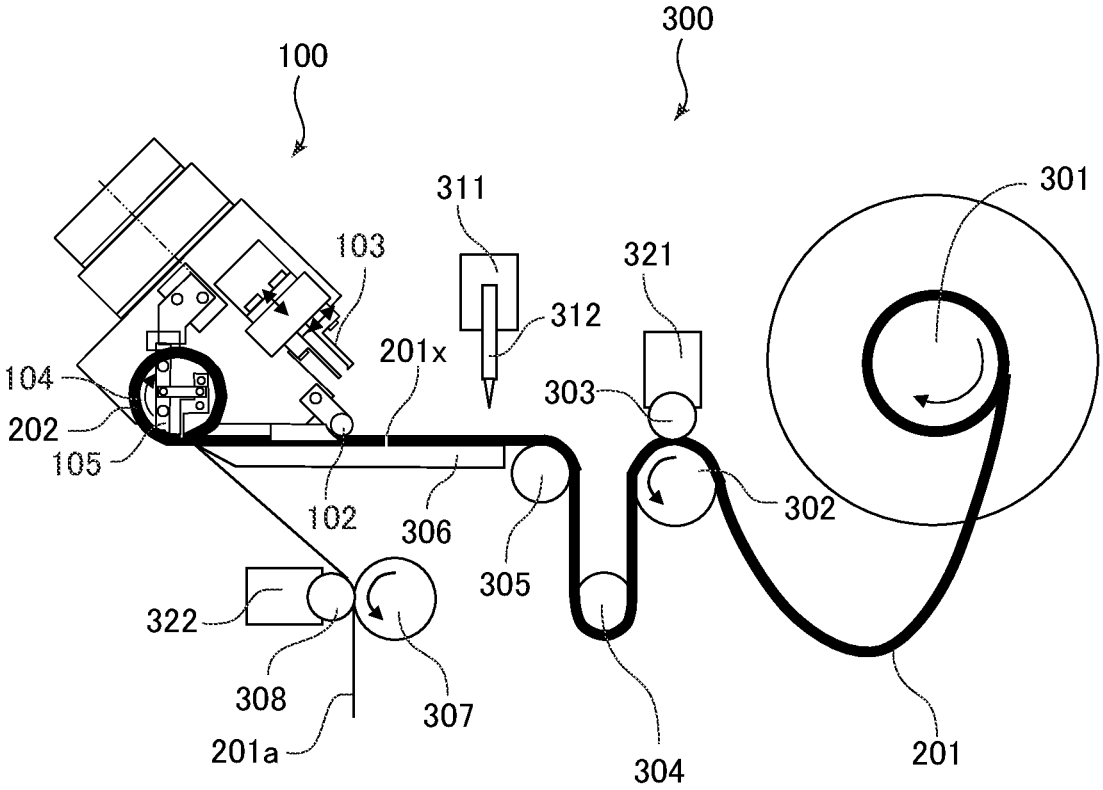
FIG. 14 is a diagram illustrating a sticker part feeding operation after cutting the sticker part.
Figure 15:
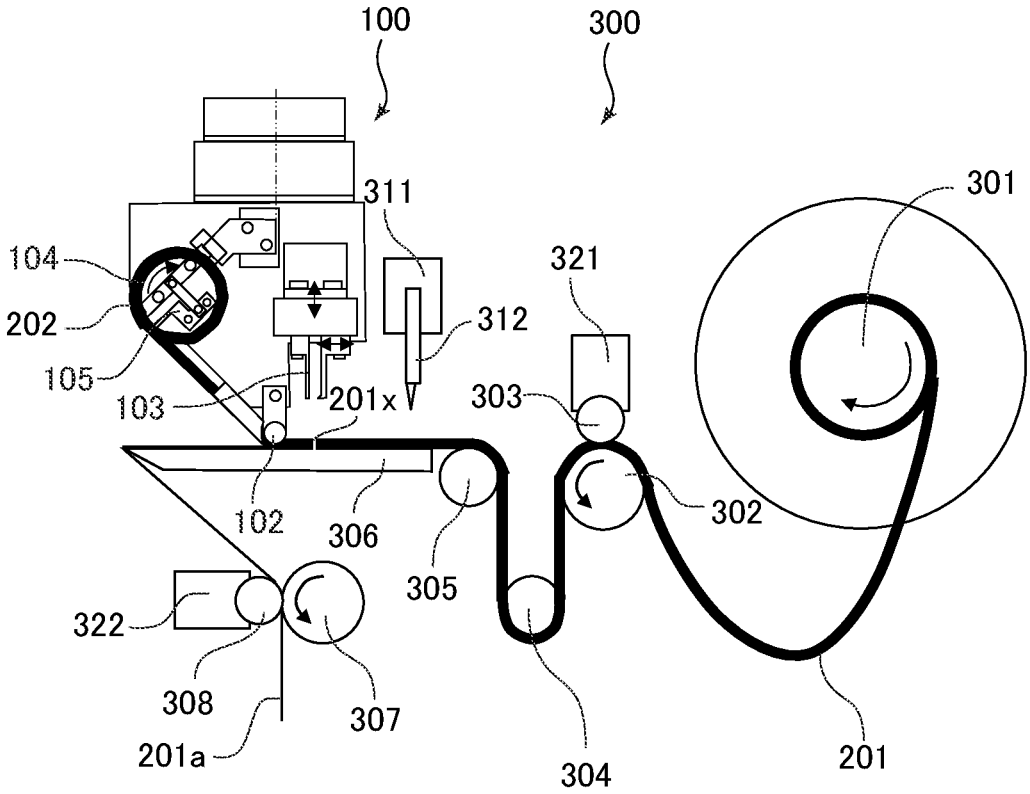
FIG. 15 is a diagram illustrating an operation of turning the peeling sticking head.
Figure 16:
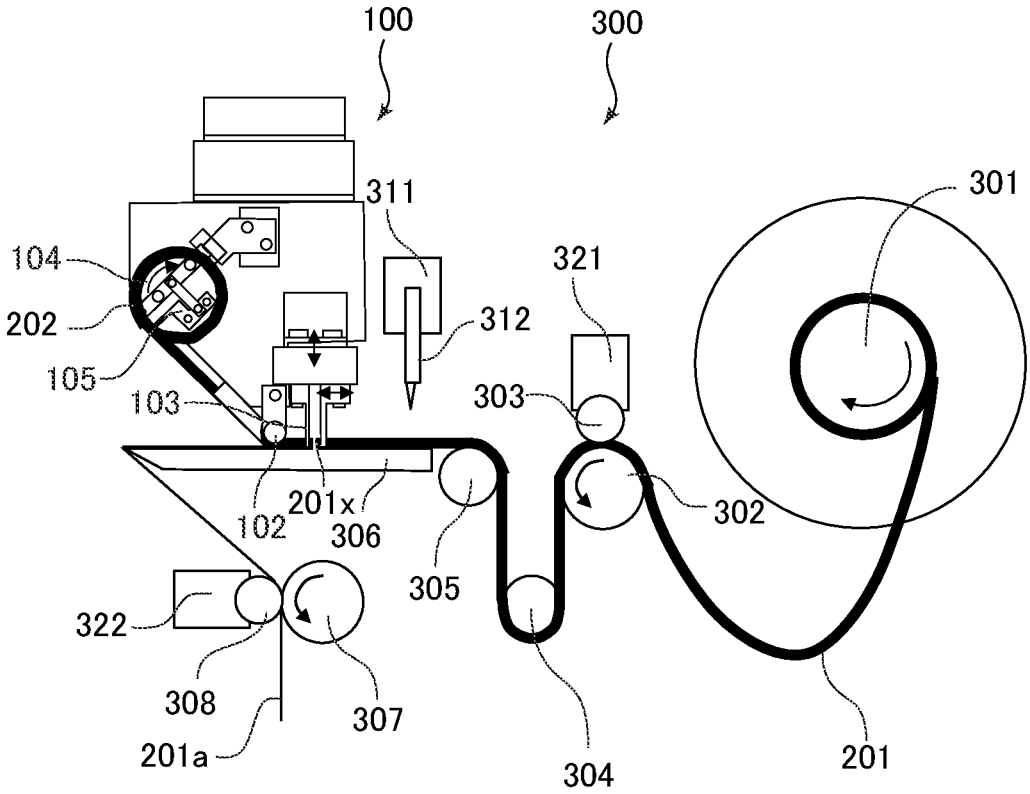
FIG. 16 is a diagram illustrating an operation of gripping the trailing end of the sticker part by the peeling sticking head.
Figure 17:
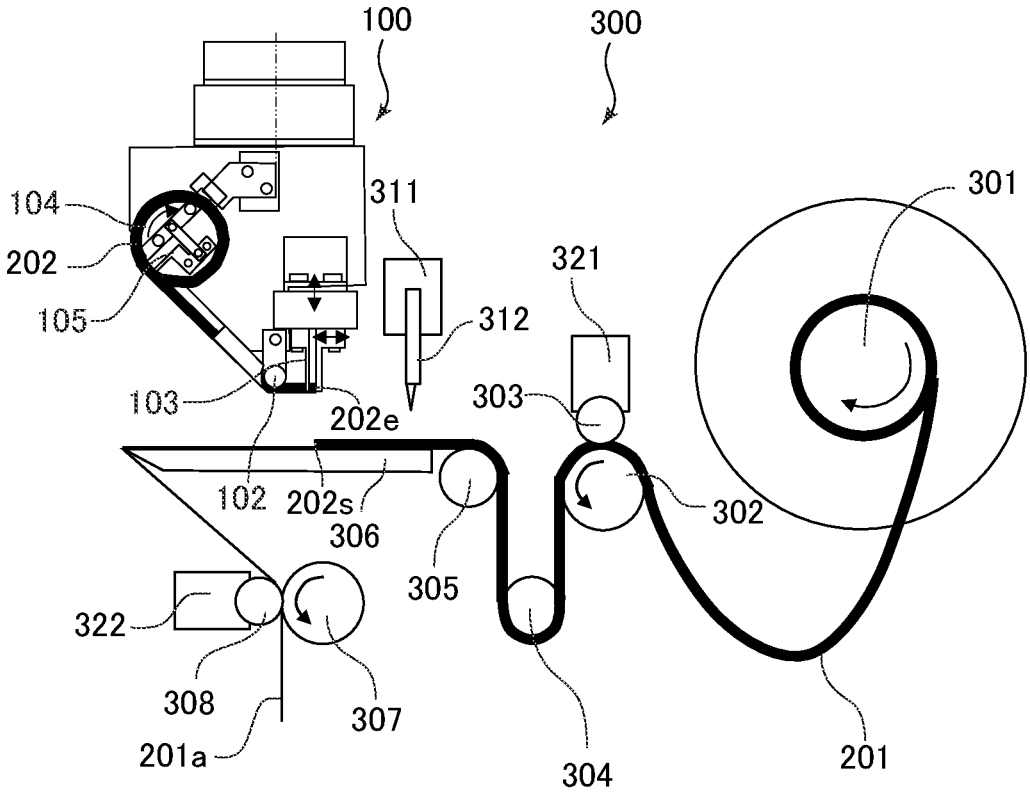
FIG. 17 is a diagram illustrating an operation of peeling off the sticker part and moving away by the peeling sticking head.
Figure 18:
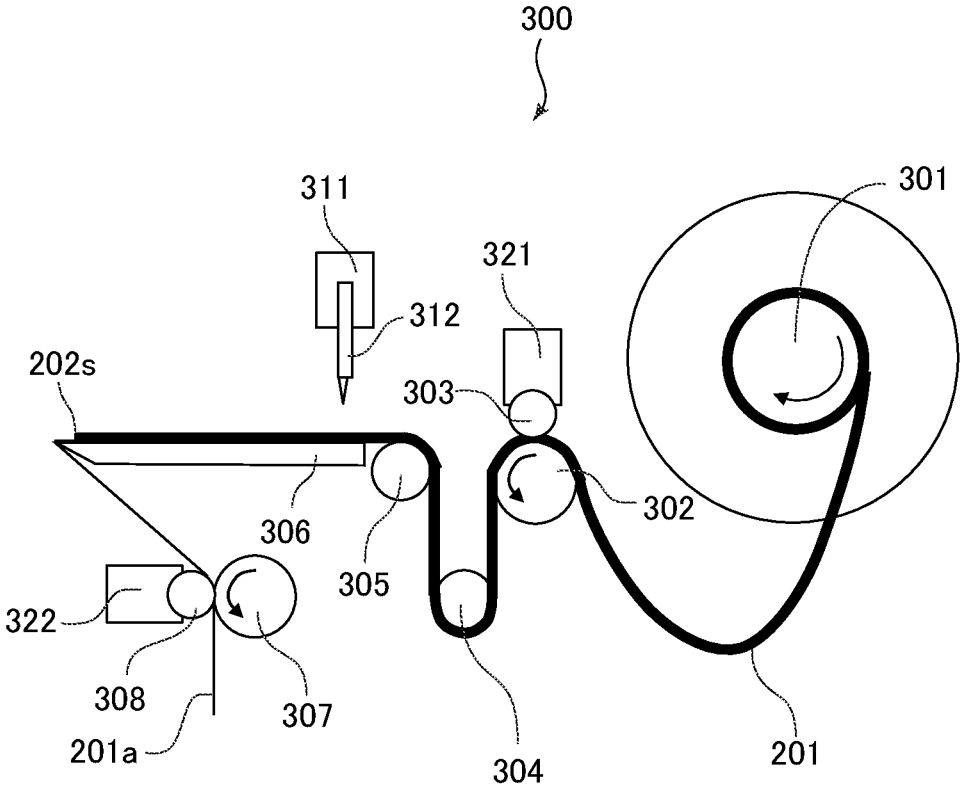
FIG. 18 is a diagram illustrating an initial state after the sticker part has been fed to a peeling start position.

Next, the operation of supplying the sticker part 202 to the robot apparatus 10 from the sticker material supply apparatus 300 in the tape material control apparatus 1000 will be described with reference to FIGS. 9 to 18. FIG. 9 is a flowchart illustrating a sticker part supply process according to the first embodiment. FIG. 10 is a diagram illustrating an operation of gripping the leading end of the sticker part by the peeling sticking head. FIG. 11 is a diagram illustrating an operation of peeling off the leading end of the sticker part from the peeling paper. FIG. 12 is a diagram illustrating an operation of peeling off and winding up the sticker part from the peeling paper by the winding roller. FIG. 13 is a diagram illustrating an operation of cutting the sticker part. FIG. 14 is a diagram illustrating the feeding operation of the sticker part after cutting the sticker part. FIG. 15 is a diagram illustrating an operation of turning the peeling sticking head. FIG. 16 is a diagram illustrating an operation of gripping the trailing end of the sticker part by the peeling sticking head. FIG. 17 is a diagram illustrating an operation of peeling off the sticker part and moving away by the peeling sticking head. FIG. 18 is a diagram illustrating an initial state in which the sticker part has been fed to the peeling start position.

Preparation Step

Before starting the operation of supplying the sticker part 202 from the sticker material supply apparatus 300 to the robot apparatus 10, preparation of the sticker material supply apparatus 300 is performed as a preparation step. First, the tape material 201 needs to be manually drawn to the supply path in the sticker material supply apparatus 300. After the completion of the drawing, the cutting blade 312 is moved down by the air cylinder 311, and thus the sticker part 202 (and the adhesive layer 201*b* attached thereto) that is to be a product is cut off without cutting the peeling paper 201*a* of the tape material 201. The sticker part 202 on the downstream side of the cutting blade 312 that has performed the cutting in the supply path is manually peeled off and removed from the supply path. Then, the peeling paper feeding roller 307 is rotated to feed the peeling paper 201*a*, and thus the tape material 201 is advanced along the supply path.

At this time, if the peeling paper feeding roller 307 is simply rotated, the dancer roller 304 moves up in accordance with the advancement of the tape material 201. Therefore, by rotating the dancer roller control roller 302 at the same timing as the rotation of the peeling paper feeding roller 307, the dancer roller 304 is controlled so as not to move up excessively. For example, the upward movement amount of the dancer roller 304 can be suppressed by rotating the dancer roller control roller 302 at a speed equal to or slightly lower than the rotational speed of the peeling paper feeding roller 307.

In addition, regarding the feeding amount of the tape material 201 at this time, the tape material 201 needs to be fed to a position where peeling of the leading end 202*s* of the cut sticker part 202 is started on the peeling stage 306, that is, to a position where the leading end 202*s* is gripped by the leading end chuck 105 of the peeling sticking head 100. Therefore, the arrival of the leading end 202*s* of the sticker part 202 is detected by the sticker material leading end detection sensor Sn4, and the rotation of the peeling paper feeding roller 307 and the dancer roller control roller 302 is stopped on the basis of the detection result. Then, to return, to a predetermined position (within a predetermined range from the original position), the position of the dancer roller 304 having moved up slightly, the dancer roller control roller 302 is rotated to a position where the position of the dancer roller 304 is detected by the dancer roller position detection sensor Sn2. Then, the dancer roller control roller 302 is stopped on the basis of the detection result.

Further, the tape material 201 fed from the supply portion 301 is pulled by the rotation of the dancer roller control roller 302 is pulled. Therefore, the supply portion 301 is rotated until the slack amount of the tape material 201 fed from the supply portion 301 being a predetermined slack amount is detected by the slack detection sensor Sn1. Then, the rotation of the supply portion 301 is stopped on the basis of the detection result. To be noted, after this, the system controller 500 controls the rotation of the supply portion 301 such that the tape material 201 between the supply portion 301 and the dancer roller control roller 302 is always maintained at a constant slack amount.

When the preparation of the sticker material supply apparatus 300 is completed as a result of the preparation step described above, the sticker material supply apparatus 300 takes the initial state illustrated in FIG. 18. The system controller 500 starts the control of the supply operation (supply process) by the tape material control apparatus 1000 in accordance with the flowchart illustrated in FIG. 9. To be noted, the following control is control (processing) basically performed solely by the system controller 500, and therefore in the following description, description indicating that the operation is performed by the system controller 500 will be omitted.

Supply Operation

Robot Moving Step

When the system controller 500 starts the control of the supply operation, the robot apparatus 10 is operated in step S1 to move the peeling sticking head 100 provided at the distal end of the robot apparatus 10 to a position (position above sticker part peeling position) above the position where the peeling of the sticker part 202 is started. That is, the leading end chuck 105 of the peeling sticking head 100 is moved to a position above the leading end 202*s* of the sticker part 202 (see FIG. 18). Then, in step S2, the peeling sticking head 100 is moved down to a position (sticker part peeling position) where the peeling of the sticker part 202 is started.

Sticker Leading End Gripping Step

Then, as illustrated in FIG. 10, in step S3, the leading end 202*s* of the sticker part 202 is gripped by causing the leading end chuck 105 to enter the leading end 202*s* of the sticker part 202 and closing the leading end chuck 105. To be noted, since the sticker part 202 is a flexible material capable of elastic deformation, the leading end chuck 105 can easily bite into and grip the sticker part 202 by entering the sticker part 202 and closing.

Peeling Starting Step of Sticker Part

Next, as illustrated in FIG. 11, to peel off the leading end 202*s* of the sticker part 202, the peeling sticking head 100 and the sticker part 202 are moved horizontally by the operation (posture change of the robot arm 10A) of the robot apparatus 10. At the same time as this, the peeling paper 201*a* is advanced in step S4 by the rotation of the peeling paper feeding roller 307. As a result of this, the leading end 202*s* of the sticker part 202 is peeled off from the peeling paper 201*a* at the sharp leading end portion 306*a* (see FIG. 3) of the peeling stage 306. The horizontal movement amount of the peeling sticking head 100 and the movement amount of the peeling paper by the rotation of the peeling paper feeding roller 307 at this time are preferably equal.

Dancer Roller Position Adjusting Step

Meanwhile, a need to return the position of the dancer roller 304 having moved up in accordance with the conveyance of the sticker part 202 and the peeling paper 201*a* (tape material 201) to a predetermined position arises. Therefore, the dancer roller control roller 302 is rotated to a position where the position of the dancer roller 304 is recognized by the dancer roller position detection sensor Sn2. At this time, the upward movement of the dancer roller 304 may be suppressed by simultaneously controlling the rotation of the peeling paper feeding roller 307 and the rotation of the dancer roller control roller 302.

Slack Amount Adjusting Step

Further, the tape material 201 fed from the supply portion 301 is pulled by the rotation of the dancer roller control roller 302. Therefore, as described above, the slack amount of the tape material 201 fed from the supply portion 301 is detected by the slack detection sensor Sn1, and the supply portion 301 is rotated such that a constant slack amount is maintained all the time.

Winding Step

Next, as illustrated in FIG. 12, in step S5, the rotation of each of the peeling paper feeding roller 307, the winding roller 104 of the peeling sticking head 100, and the dancer roller control roller 302 is controlled while controlling these individually in synchronization with each other. That is, the conveyance of the peeling paper 201*a* by the rotation of the peeling paper feeding roller 307 and the winding of the sticker part 202 by the rotation of the winding roller 104 are performed at the same timing in parallel with each other. At this time, the winding roller 104 winds up the sticker part 202 spirally by the rotation and movement in the axial direction. In addition, by also performing the rotation of the dancer roller control roller 302 in parallel, the upward movement amount of the dancer roller 304 is also suppressed. By controlling each roller individually as described above, the sticker part 202 is wound around the winding roller 104 without moving the peeling sticking head 100, that is, without moving or changing the posture of the robot arm 10A at all.

Calculation of Conditions of Rotation Control of Each Roller.

At this time, it is preferable that the movement amount of the peeling paper 201*a* by the rotation of the peeling paper feeding roller 307 and the movement amount of the adhesive layer 201*b* (such as a double-sided tape) in the sticker part 202 to be wound around the winding roller 104 are equal. However, since the sticker part 202 is wound around the winding roller 104 by applying a constant tension to the sticker part 202, compression of the soft material of the sticker part 202 needs to be taken into consideration.

Here, for example, for a case where the winding is performed by the winding roller 104 while applying a tension of 1 N, an example of calculation of the rotation control conditions of the peeling paper feeding roller 307 and the winding roller 104 will be described. For example, the sticker part 202 has a length of 1500 mm, and includes a soft material layer having a compression rate of 50% and a thickness of 5 mm under application of a tension of 1 N. In addition, for example, the peeling paper feeding roller 307 and the winding roller 104 each have a diameter of 80 mm.

First, since the thickness of the peeling paper 201*a* fed by the peeling paper feeding roller 307 is minute, the thickness is almost negligible. Therefore, the conveyance amount of the peeling paper 201*a* by one rotation of the peeling paper feeding roller 307 is "80×3.14≈251.3 mm" by calculation from the diameter of 80 mm and pi. Therefore, to convey the sticker part 202 by the whole length of 1500 mm, the peeling paper feeding roller 307 needs to be rotated about six times in accordance with "1500/251.3≈6". Further, in the case where the conveyance speed of the peeling paper 201*a* is set to 200 mm/s, the rotational angular velocity of the peeling paper feeding roller 307 is "200/251.3×360≈286.5 (deg/s)".

Next, the thickness of the sticker part 202 wound up by applying a tension of 1 N by the winding roller 104 becomes "5×0.5=2.5 mm" because the soft material layer thereof is compressed. In addition, the adhesive layer 201*b* is formed from, for example, a double-sided tape, is hardly extendable or contractable, and is positioned on the outer circumferential side of the flexible layer when wound around the winding roller 104. Therefore, the winding amount of the sticker part 202 by one rotation of the winding roller 104 is "(80+2.5×2)×3.14=267 mm" in consideration of the diameter 80 mm of the winding roller 104 and the thickness 2.5 mm of the sticker part 202 to be wound up. That is, "(diameter of winding roller+compression rate×thickness of sticker member×2)× pi=length of adhesive layer of wound-up sticker part per rotation" holds. Therefore, to wind up the sticker part 202 for the whole length of 1500 mm, the winding roller 104 needs to be rotated by about 5.6 times in accordance with "1500/267≈5.6". Further, in the case where the winding speed of the sticker part 202 is set to 200 mm/s similarly to the conveyance speed of the peeling paper 201*a*, the rotational angular velocity of the winding roller 104 (that is, the rotational speed of the winding roller 104) is "200/267×360≈269.6 (deg/s)". To be noted, strictly speaking, it is preferable that the distance between the leading end chuck 105 and the trailing end chuck 103 is subtracted from the total length of 1500 mm of the sticker part 202.

In the description above, a case where the conveyance speed of the peeling paper 201*a* by the rotation of the peeling paper feeding roller 307 and the winding speed of the sticker part 202 by the rotation of the winding roller 104 are both set to 200 mm/s has been described. However, the configuration is not limited to this, and the user may intentionally provide a speed difference in consideration of the difference in the extension amount or the like between the peeling paper 201*a* and the sticker part 202.

Winding Finishing Step

Next, when winding of the sticker part 202 of a predetermined length is finished, in step S6, the rotation of the peeling paper feeding roller 307, the winding roller 104, and the dancer roller control roller 302 is stopped. Specifically, the conveyance of the tape material 201 is progressed by rotating each roller until the length from the leading end 202*s* of the wound-up sticker part 202 to the descending position (cutting position) of the cutting blade 312 is equal to the length of one sticker part 202. Then, similarly to the processing described above, to return, to the predetermined position, the position of the dancer roller 304 having moved up, the dancer roller control roller 302 is rotated to the position where the position of the dancer roller 304 is detected by the dancer roller position detection sensor Sn2. To be noted, since the length of the sticker part 202 to be wound around the winding roller 104 can be arbitrarily set, a case where the length of the sticker part 202 to be used is different can be also easily addressed by controlling the rotation amount of each roller.

Sticker Part Cutting Step

Next, as illustrated in FIG. 13, the cutting blade 312 is moved down by the cutting blade moving air cylinder 311, and thus the cutting edge is caused to enter to about a half of the thickness of the peeling paper 201*a* in the thickness direction beyond the thickness of the sticker part 202 and the adhesive layer 201*b* (double-sided tape). As a result of this, the sticker part 202 (soft material layer and adhesive layer) of the tape material 201 is cut in step S7. To be noted, for example, in the case where the thickness of the peeling paper 201*a* is 0.15 mm, it is preferable that the gap between the peeling stage 306 that receives the tape material 201 and the cutting edge of the cutting blade 312 is set to 0.075 mm, and the descent end of the cutting blade moving air cylinder 311 is mechanically adjusted by a stopper or the like. In addition, an ultrasonic cutter may be used instead of a normal cutting blade, and in this case, the cutting blade may be moved down while applying a predetermined ultrasonic vibration thereto, or the ultrasonic vibration may be applied after the cutting blade has reached the descent end. In addition, at this time, the descent end of the cutting blade needs to be adjusted in consideration of the amplitude of the ultrasonic vibration so as not to cut the peeling paper 201*a*.

Sticker Part Cutting Ending Step

Next, after the cutting of the sticker part 202 (and the adhesive layer 201*b*) is completed, the cutting blade 312 is moved up by the cutting blade moving air cylinder 311 in step S8.

Post-Cutting Winding Step

Next, as illustrated in FIG. 14, in step S9, the rotation of each of the peeling paper feeding roller 307, the winding roller 104 of the peeling sticking head 100, and the dancer roller control roller 302 is controlled again while controlling these individually in synchronization with each other. Similarly to step S5 described above, the conveyance of the peeling paper 201*a* by the rotation of the peeling paper feeding roller 307 and the winding of the sticker part 202 by the rotation of the winding roller 104 are performed at the same timing in parallel with each other. At this time, the winding roller 104 spirally winds up the sticker part 202 by rotation and the movement in the axial direction. In addition, by also performing the rotation of the dancer roller control roller 302 in parallel, the upward movement amount of the dancer roller 304 is also suppressed. To be noted, in this step S9, since the tape material 201 is conveyed until a cut portion 201*x* of the sticker part 202 reaches a position to which the trailing end chuck 103 is moved down for the gripping, the rotation amount of each roller is very small. In addition, also at this time, the sticker part 202 is wound around the winding roller 104 without moving or changing the posture of the robot arm 10A at all.

Then, when a trailing end 202*e* of the sticker part 202 is conveyed to a trailing end gripping position where the trailing end 202*e* can be gripped by the trailing end chuck 103 as will be described later, the rotation of the dancer roller control roller 302, the peeling paper feeding roller 307, and the winding roller 104 is stopped.

Peeling Sticking Head Turning Step

Next, as illustrated in FIG. 15, in step S10, the robot apparatus 10 is operated (posture of the robot arm 10A is changed) to turn the peeling sticking head 100 in the clockwise direction in the drawing such that the opening/closing direction of the trailing end chuck 103 of the peeling sticking head 100 is horizontal. At this time, it is preferable that the peeling sticking head 100 is turned about the pressing roller 102 of the peeling sticking head 100 as a turning center such that extension or contraction of the sticker part 202 does not occur. In addition, as a result of the turning of the peeling sticking head 100, the trailing end chuck 103 is positioned right above the trailing end 202*e* of the sticker part 202 to face the trailing end 202*e*.

Trailing End Chuck Entering Step

Next, as illustrated in FIG. 16, the trailing end chuck 103 is moved in the up-down direction by the trailing end chuck moving air cylinder 107 provided in the peeling sticking head 100, and thus the chuck is caused to enter the trailing end 202*e* of the sticker part 202 in step S11.

Trailing End Chuck Gripping Step

Next, in step S12, the trailing end chuck 103 is closed by the trailing end chuck opening/closing air cylinder 106 provided in the peeling sticking head 100, and thus the trailing end 202*e* of the sticker part 202 is gripped.

Sticker Part Peeling Completion Step

Next, in step S13, the robot apparatus 10 is operated (posture of the robot arm 10A is changed) to move up the peeling sticking head 100, and thus the sticker part 202 is peeled off from the peeling paper 201*a* as illustrated in FIG. 17. As a result of this, the sticker part 202 of a predetermined length is supplied from the sticker material supply apparatus 300 to the peeling sticking head 100 of the robot apparatus 10. To be noted, in the case where the peeling of the sticker part 202 is not completed for some reason, that is, in the case where the result of step S14 is NO, the process returns to step S1 described above, and the control described above is repeated until the peeling of the sticker part 202 is completed. Then, in the case where it is determined that the peeling of the sticker part 202 is completed, that is, in the case where the result of step S14 is YES, the process proceeds to the next step (for example, a sticker part sticking step that will be described later).

Initial State Transition Step

Then, as illustrated in FIG. 18, the leading end 202*s* of the cut sticker part 202 is fed to a position where the peeling on the peeling stage 306 is started, that is, to a position where the cut sticker part 202 is gripped by the leading end chuck 105 of the peeling sticking head 100. At this time, similarly to the preparation step, the arrival of the leading end 202*s* of the sticker part 202 is detected by the sticker material leading end detection sensor Sn4, and the rotation of the peeling paper feeding roller 307 and the dancer roller control roller 302 is stopped on the basis of the detection. Then, to return, to a predetermined position (within a predetermined range from the original position), the position of the dancer roller 304 having slightly moved up, the dancer roller control roller 302 is rotated to a position where the position of the dancer roller 304 is detected by the dancer roller position detection sensor Sn2. Then, the dancer roller control roller 302 is stopped on the basis of the detection result.

To be noted, in the first embodiment, a case where the rotation of the peeling paper feeding roller 307 and the dancer roller control roller 302 is stopped by detecting the arrival of the leading end 202*s* of the sticker part 202 by the sticker material leading end detection sensor Sn4 has been described. However, the configuration is not limited to this, and the rotation amount of the peeling paper feeding roller 307 and the dancer roller control roller 302 may be controlled such that the leading end 202*s* of the sticker part 202 moves from the gripping position of the trailing end chuck 103 to the gripping position of the leading end chuck 105.

In addition, in the series of operations, the slack amount of the tape material 201 fed from the supply portion 301 is always maintained at a predetermined amount or more. That is, the slack detection sensor Sn1 always detects the slack amount, and when the slack amount becomes a predetermined amount of less, the supply portion 301 is rotated to generate the slack of the predetermined amount or more, and thus a state in which the tape material 201 is slack is maintained all the time. That is, the rotation and stoppage of the supply portion 301 are controlled only in accordance with the slack amount of the tape material 201 independently from the rotation operation of each roller.

Sticker Part Sticking Step

When the supply of the sticker part 202 to the winding roller 104 of the peeling sticking head 100 is completed as described above, the peeling sticking head 100 is moved to a position above the workpiece 400 by changing the posture of the robot arm 10A by operating the robot apparatus 10. Next, for example, a feature point of the workpiece 400 is detected by the on-hand camera 115, the sticking position of the sticker part 202 is detected, and the trailing end chuck 103 is moved to a sticking start position of the workpiece 400. Then, the pressing roller 102 presses the sticker part 202 onto the sticking position on the workpiece 400. Then, while the movement of the robot arm 10A is controlled to move the peeling sticking head 100 to the sticking position on the workpiece 400, the rotational speed of the winding roller 104 is controlled by the winding roller rotation control portion 510. At this time, the sticking speed is controlled by rotating the winding roller 104 in a direction opposite to the rotational direction for winding up the sticker part 202 while moving the winding roller 104 also in the axial direction. As a result of this, the sticker part 202 is stuck onto the workpiece 400 from the winding roller 104, and finally the gripping by the leading end chuck 105 is cancelled to complete the sticking of the sticker part 202 onto the workpiece 400. As a result of this, the workpiece 400 to which the sticker part 202 is stuck can be manufactured. To be noted, after this, the process returns to the robot moving step (see S1) described above and returns to the supply operation of the next sticker part 202, or in the case where it has been determined that all the manufacturing steps have been finished, all the work process by the tape material control apparatus 1000 described above is finished.

Summary of First Embodiment

As described above, according to the tape material control apparatus 1000 of the first embodiment, the system controller 500 individually controls the rotation of each of the dancer roller control roller 302, the peeling paper feeding roller 307, and the winding roller 104. That is, the feeding speed of the tape material 201 by the dancer roller control roller 302, the conveyance speed of the peeling paper 201*a* by the peeling paper feeding roller 307, and the winding speed of the sticker part 202 by the winding roller 104 are individually controlled. Further, according to this control, the sticker part 202 is supplied from the sticker material supply apparatus 300 to the robot apparatus 10 while making the movement distance of the peeling sticking head 100 smaller than the length of the sticker part 202 to be wound around the winding roller 104. Therefore, the sticker part 202 of an arbitrary length can be wound around the winding roller 104 while making the movement of the peeling sticking head 100 as small as possible.

That is, when starting the peeling of the sticker part 202 (see FIG. 11), when turning the peeling head (see FIG. 15), and when completing the peeling of the sticker part (see FIG. 17), the turning and movement of the peeling sticking head 100 is performed by changing the posture of the robot arm 10A. However, in the supply operation of the sticker part 202 other than this, the supply of the sticker part 202 from the sticker material supply apparatus 300 to the robot apparatus 10 is achieved by winding up the sticker part 202 without moving the peeling sticking head 100. Particularly, when winding up the sticker part 202 by the winding roller 104 (see FIGS. 12 and 14), the winding of the sticker part 202 is performed in a state in which the posture of the robot arm 10A is maintained without changing. Therefore, the movement distance of the peeling sticking head 100 is smaller than the length of the sticker part 202 wound around the winding roller 104. Therefore, the movement distance of the peeling sticking head 100 can be made as small as possible all the time regardless of the length of the sticker part 202 wound around the winding roller 104. As a result of this, increase in the overall size of the tape material control apparatus 1000 can be suppressed. In addition, even if the length of the sticker part 202 is larger than the size of the sticker material supply apparatus 300, the sticker part 202 can be supplied to the robot apparatus 10, that is, the versatility can be improved.

In addition, if the type of the sticker part 202 is different, the thickness and compression rate thereof differ, and therefore the diameter of the sticker part 202 in the state of being wound around the winding roller 104 changes. Therefore, there is a possibility that the winding speed does not match, thus loosening or tightening occurs, and the winding of the sticker part 202 cannot be performed normally unless the winding speed of the winding roller 104 with respect to the conveyance speed of the peeling paper feeding roller 307 is relatively changed in accordance with the thickness and compression rate. However, in the first embodiment, the winding speed of the sticker part 202 around the winding roller 104 with respect to the conveyance speed of the peeling paper 201*a* by the peeling paper feeding roller 307 is adjusted and controlled as in the example of the condition calculation described above in accordance with the type of the sticker part 202, particularly with the thickness and compression rate. As a result of this, normal winding of the sticker part 202 can be achieved.

Further, the peeling sticking head 100 includes the ball spline shaft 114 that moves the winding roller 104 in the axial direction, and the sticker part 202 is spirally wound around the winding roller 104 by moving the winding roller 104 in the axial direction in synchronization with the rotation of the winding roller 104. As a result of this, the sticker part 202 longer than the outer circumferential length of the winding roller 104 can be wound up without increasing the diameter of the winding roller 104.

Second Embodiment

A second embodiment having a configuration partially modified from the first embodiment described above will be described with reference to FIGS. 19 to 23. To be noted, in the description below, elements identical to or corresponding to those in the first embodiment described above will be denoted by the same reference signs, and description thereof will be omitted or simplified. Parts different from the first embodiment described above will be mainly described.

As described above, in Japanese Patent Application Laid-Open No. 2022-65833, a tape material is set on a tool, and the tape material is wound around a reel provided at a distal end of a robot. However, for example, in the case of cutting off a sticker part from the tape material and causing a sticking apparatus (head) of the robot to hold the sticker part, the cutting position of the sticker part is limited by the movable range of the robot, which leads to low versatility as manufacture equipment.

In addition, as described above, in Japanese Patent Application Laid-Open No. 2020-47767, a protective sheet is peeled off while moving a peeling unit. However, for example, in the case of cutting off a sticker part from a tape material and causing a sticking apparatus (head) of the robot to hold the sticker part, it is not realistic to move the cutting blade in accordance with the movement of the tape material, and the versatility thereof is low.

Further, in Japanese Patent Application Laid-Open No. 2010-23131, after cutting a protective film and an adhesive layer by a cutting blade of a half-cut apparatus, these are conveyed to a peeling roller and peeled off from a separator. However, since these are conveyed to the peeling roller after temporarily moving the cutting blade of the half-cut apparatus away from the adhesive layer, there is a possibility that reattachment occurs at the adhesive layer separated from the cutting blade, and a peeling failure in which the peeling cannot be performed can occur. To be noted, in Japanese Patent Application Laid-Open No. 2010-23131, half-cut in which the separator is not cut is realized by matching the dimension of the cutting blade projecting from an emboss stage with the thickness of the protective film and the adhesive layer. However, since the thickness of the portion to be cut changes depending on the material, the position of the edge of the cutting blade needs to be adjusted in accordance with the material to be cut, which leads to low versatility.

In the second embodiment, an example of a structure (method) for solving these problems will be described below.

Schematic Configuration of Tape Material Control Apparatus

Figure 19:
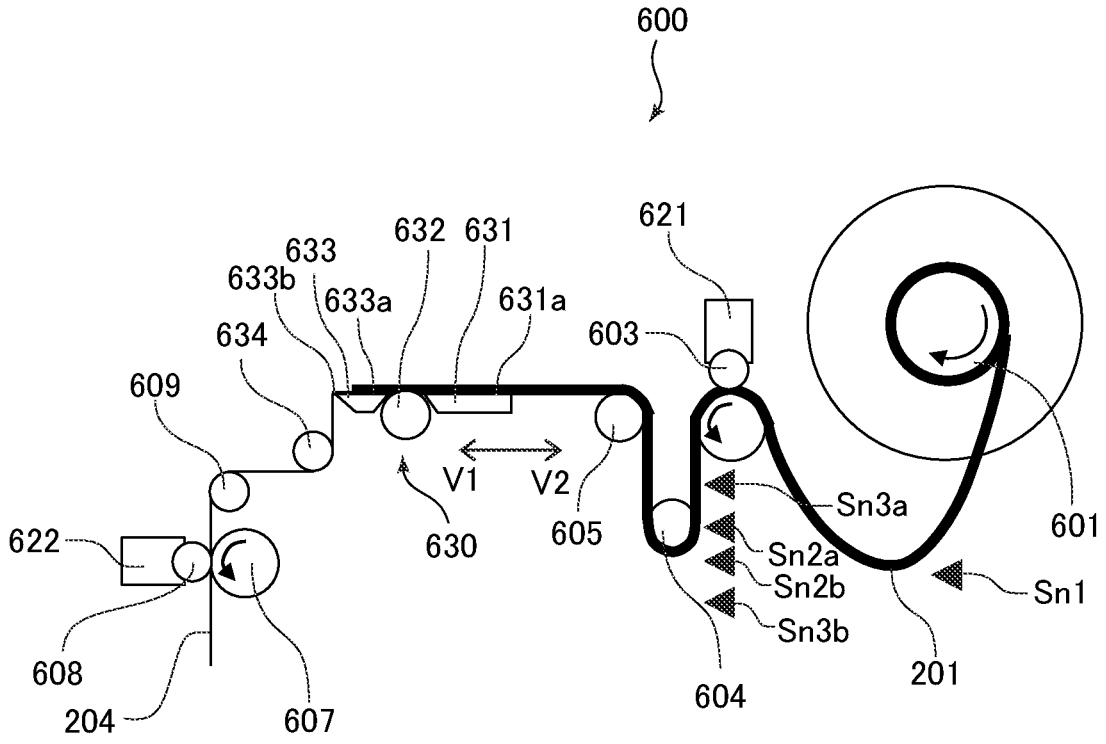
FIG. 19 is a schematic front view of a sticker material supply apparatus according to a second embodiment.

First, a sticker material supply apparatus 600 serving as a supply apparatus according to the second embodiment will be described with reference to FIG. 19. FIG. 19 is a schematic front view of the sticker material supply apparatus 600 according to the second embodiment.

Figure 20:
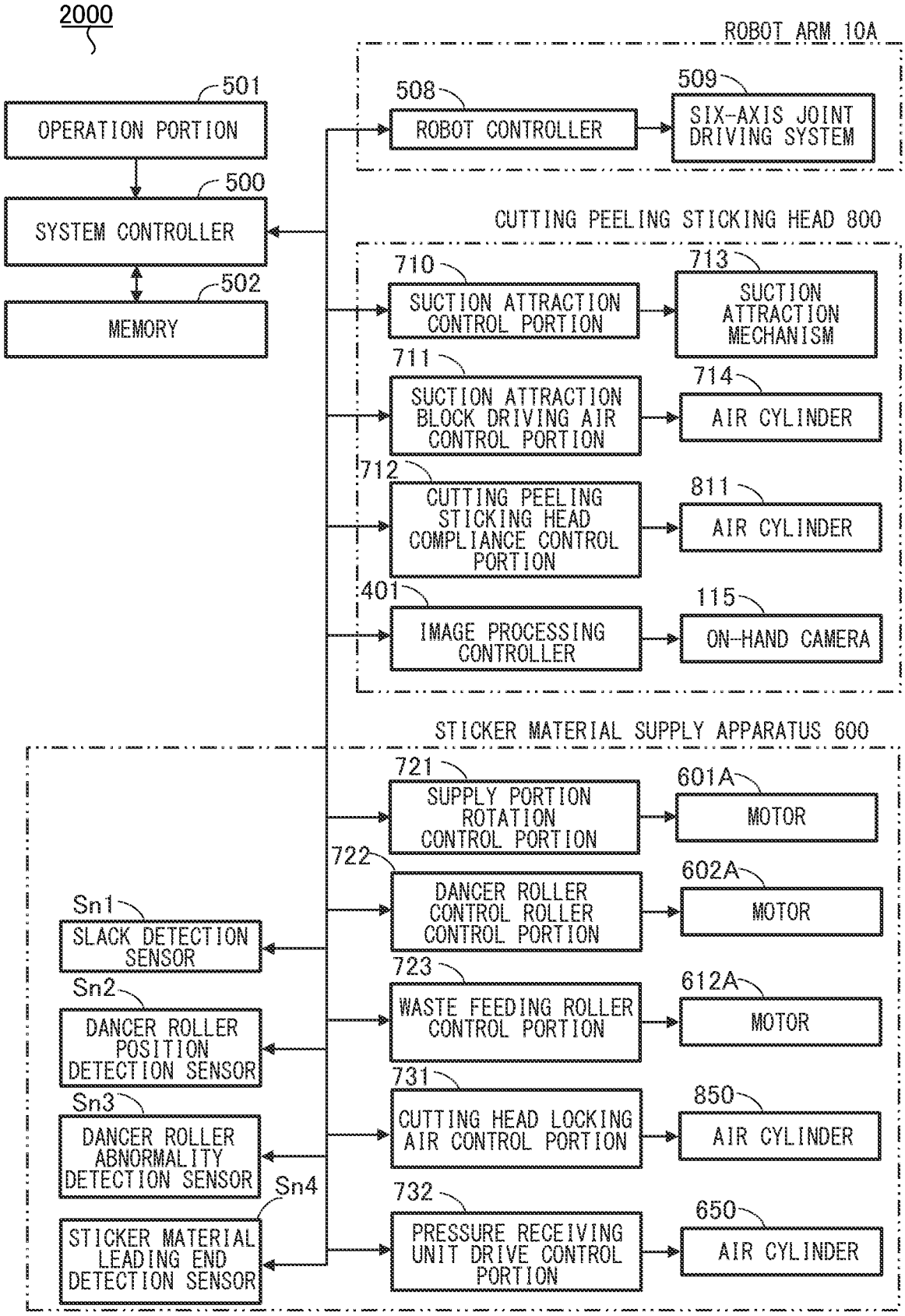
FIG. 20 is a block diagram illustrating a control system of a tape material control apparatus according to the second embodiment.

The sticker material supply apparatus 600 is disposed in the vicinity of a robot apparatus having a configuration similar to the robot apparatus 10 described in the first embodiment above, and constitutes a tape material control apparatus 2000 (see FIG. 20). To be noted, a cutting peeling sticking head 800 serving as an end effector that will be described in detail later is attached to the robot apparatus 10 in the second embodiment, and the robot apparatus 10 is configured in a similar manner to the first embodiment except for this. The tape material control apparatus 2000 according to the second embodiment causes the cutting peeling sticking head 800 of the robot apparatus 10 to peel off and hold a sticker part 203 that will be described later from the tape material 201 of the sticker material supply apparatus 600. Further, the tape material control apparatus 2000 moves the cutting peeling sticking head 800 of the robot apparatus 10 holding the sticker part 203 to the vicinity of an unillustrated workpiece, and performs a work of sticking the held sticker part 203 to the unillustrated workpiece.

As illustrated in FIG. 19, the sticker material supply apparatus 600 includes a supply portion 601, a dancer roller control roller 602 serving as a first roller, a pressing roller 603, and a dancer roller 604 that are supported by a side plate (see FIG. 1) whose illustration is omitted in FIG. 19. Further, the sticker material supply apparatus 600 includes a pressure receiving unit 630 serving as a cutting unit supported to be movable in a V1-V2 direction that is a conveyance direction of the tape material 201 (horizontal direction in the second embodiment) with respect to the side plate whose illustration is omitted. The pressure receiving unit 630 includes a receiving stage 631, a cutting roller 632, a peeling stage 633, and a feeding roller 634, and is capable of moving these collectively in the V1-V2 direction. In addition, the sticker material supply apparatus 600 includes a pressing roller 609, a waste material feeding roller 607 serving as a second roller, and a pressing roller 608 that are supported by the side plate whose illustration is omitted. Further, the sticker material supply apparatus 600 is configured such that the tape material 201 is drawn around via each of these rollers.

To be noted, in the second embodiment, part of the adhesive layer 201*b* and the soft material layer 201*c* laminated on the peeling paper 201*a* of the tape material 201 is cut (see FIG. 22A), and the cut portion is attracted by suction to the cutting peeling sticking head 800 that will be described later. In the description below, the cut sticker part that is part of the adhesive layer 201*b* and the soft material layer 201*c* will be referred to as a sticker part 203. In addition, in the second embodiment, not only the peeling paper 201*a* is discarded but the soft material layer 201*c* from which the sticker part 203 has been cut off and in which a hole is opened is discarded in the state of still being stuck to the peeling paper 201*a*. Therefore, this tape material in which a hole is opened will be referred to as a waste material 204.

As illustrated in FIG. 19, the supply portion 601 is constituted by setting a supply roll around which the tape material 201 is wound, and the rotational speed thereof is controlled by a motor 601A (see FIG. 20) whose rotation is controlled by a supply portion rotation control portion 721. That is, the supply speed of the supply portion 601 feeding and supplying the tape material 201 by being rotationally driven is controlled by the system controller 500. In addition, the supply portion 601 supplies the tape material 201 such that slack of the tape material 201 occurs between the supply portion 601 and the dancer roller control roller 602. That is, the slack amount of the tape material 201 is detected by a slack detection sensor Sn1 serving as a third detection portion constituted by an optical sensor or the like disposed in a lower portion of the supply portion 601, and the rotation of the supply portion 601 is controlled by the system controller 500 so as to always maintain a constant slack amount.

The rotation speed of the dancer roller control roller 602 is controlled by a motor 602A (see FIG. 20) whose rotation is controlled by a dancer roller control roller control portion 722 serving as a first rotary driving portion. That is, the dancer roller control roller 602 is rotated so as to feed the tape material 201 to the dancer roller 604 and the peeling position (supply position of sticker part 203) that will be described later. In addition, the pressing roller 603 is configured to be capable of pressurization by opening and closing with respect to the dancer roller control roller 602 by an air cylinder 621. The pressing roller 603 is rotated by being driven via the tape material 201 by rotating the dancer roller control roller 602 in a state in which the tape material 201 is clamped between the dancer roller control roller 602 and the pressing roller 603.

The dancer roller 604 is supported so as to be slidable in the up-down direction by a support mechanism whose illustration is omitted, and is urged downward by an unillustrated urging member such as a spring or by the weight thereof. Further, the dancer roller 604 is disposed so as to press the tape material 201 stretched between the dancer roller control roller 602 and the stretch roller 605 from above. To be noted, the stretch roller 605 is configured to rotate by being driven by the tape material 201. The dancer roller 604 configured in this manner is configured to apply a constant tension to the tape material 201 drawn to the sticker material supply apparatus 600.

That is, the system controller 500 moves down the dancer roller 604 by feeding the tape material 201 by the rotation of the dancer roller control roller 602, and moves up the dancer roller 604 by conveying the waste material 204 by the rotation of the waste material feeding roller 607. By moving up or down the dancer roller 604 in this manner, the length of the passage path of the tape material between the waste material feeding roller 607 and the dancer roller control roller 602 is increased or decreased. Therefore, basically, the tension is applied to the tape material 201 without changing the position of the dancer roller 604, by controlling the waste material feeding roller 607 and the dancer roller control roller 602 to the same timing and the same conveyance speed.

To be noted, even if the waste material feeding roller 607 and the dancer roller control roller 602 are controlled to the same conveyance speed, the dancer roller 604 moves up or down in the actual operation. Therefore, the sticker material supply apparatus 600 is provided with the dancer roller position detection sensor Sn2 (see FIG. 20) serving as a first detection portion. For example, the dancer roller position detection sensor Sn2 includes the upper position detection sensor Sn2*a* and the lower position detection sensor Sn2*b* as illustrated in FIG. 19. It is assumed that, for example, the upper position detection sensor Sn2*a* has detected upward movement of the dancer roller 604 by a predetermined amount from the original position. In this case, the dancer roller 604 is moved down to be closer to the original position by increasing the feeding speed of the dancer roller control roller 602 such that there is a speed difference between the feeding speed of the dancer roller control roller 602 and the conveyance speed of the waste material feeding roller 607. Conversely, it is assumed that, for example, the lower position detection sensor Sn2*b* has detected downward movement of the position of the dancer roller 604 by a predetermined amount from the original position. In this case, the dancer roller 604 is moved up to be closer to the original position by decreasing the feeding speed of the dancer roller control roller 602 such that there is a speed difference between the feeding speed of the dancer roller control roller 602 and the conveyance speed of the waste material feeding roller 607.

In addition, there is a possibility that an abnormality such as stoppage of the tape material 201 by slipping or being caught by one of the rollers occurs. Therefore, the sticker material supply apparatus 600 is provided with the dancer roller abnormality detection sensor Sn3 (see FIG. 20) serving as a second detection portion. For example, the dancer roller abnormality detection sensor Sn3 includes the upper abnormality detection sensor Sn3*a* and the lower abnormality detection sensor Sn3*b* as illustrated in FIG. 19. The upper abnormality detection sensor Sn3*a* and the lower abnormality detection sensor Sn3*b* are disposed at positions farther away from the original position in the up-down direction than the upper position detection sensor Sn2*a* and the lower position detection sensor Sn2*b* that are described above. Further, it is assumed that one of the upper abnormality detection sensor Sn3*a* and the lower abnormality detection sensor Sn3*b* has detected movement of the dancer roller 604 thereto. That is, in this case, abnormality is detected and the sticker material supply apparatus 600 is stopped as a case where the position of the dancer roller 604 has moved up or down to an abnormal position beyond a normal movement range (predetermined range) including the original position.

To be noted, although a case where the dancer roller position detection sensor Sn2 and the dancer roller abnormality detection sensor Sn3 are configured as separate sensors has been described in the present embodiment as described above, the configuration is not limited to this, and these may be constituted by a single sensor. The form of the sensor is not limited, and for example, the position of a member that moves together with the dancer roller 604 in a support mechanism (not illustrated) supporting the dancer roller 604 may be detected by an encoder, a laser distance meter, or the like.

The rotational speed of the waste material feeding roller 607 is controlled by a motor 612A (see FIG. 20) whose rotation is controlled by a waste material feeding roller control portion 723 serving as a second rotary driving portion. That is, the waste material feeding roller 607 is rotated to convey the tape material 201 positioned downstream of the dancer roller 604 in the conveyance direction. In addition, the pressing roller 608 is configured to be capable of pressurization by opening and closing with respect to the waste material feeding roller 607 by an air cylinder 622. The pressing roller 608 is rotated by being driven via the waste material 204 by waste material feeding roller 607 in a state in which the waste material 204 is clamped between the waste material feeding roller 607 and the pressing roller 608. To be noted, the waste material 204 fed by the rotation of the waste material feeding roller 607 may be collected into a collecting box or the like as it is, or may be wound up by an unillustrated roller and collected as a roll of a certain amount.

Configuration of Cutting Peeling Sticking Head

Figure 21A:
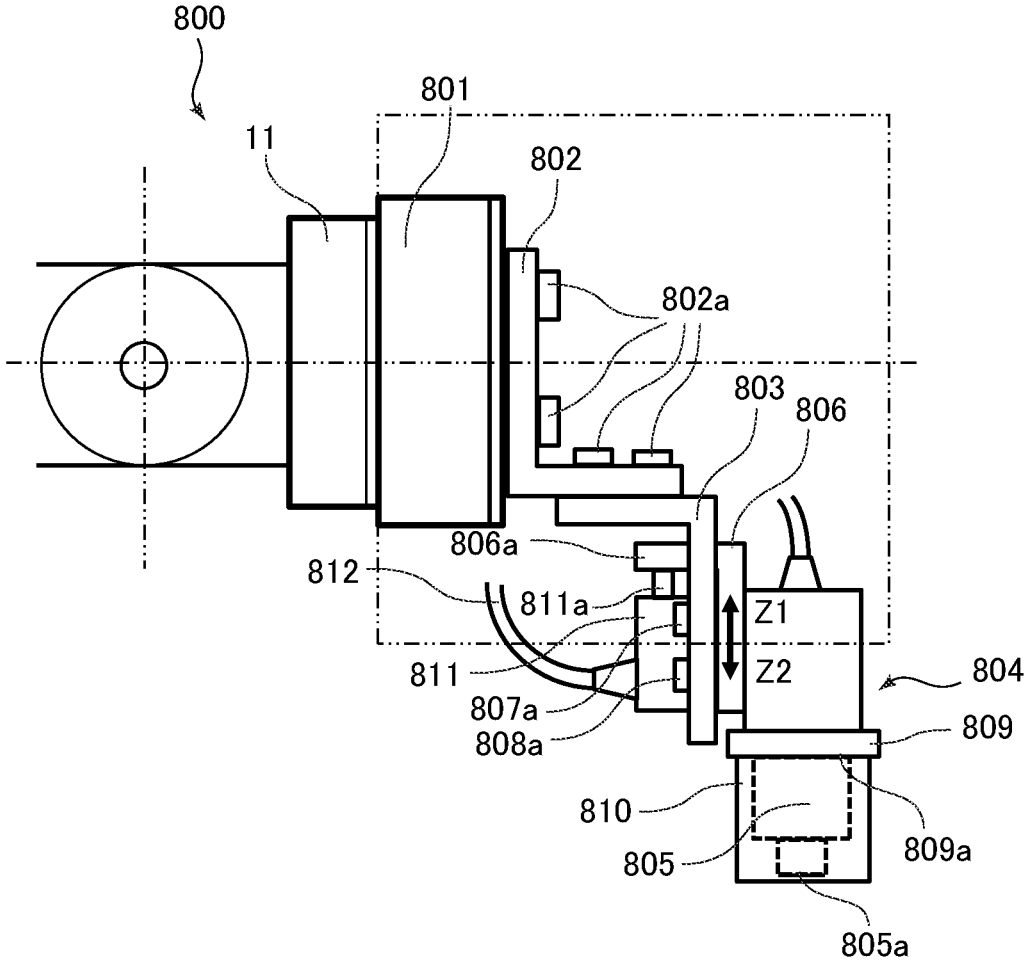
FIG. 21A is a schematic side view of a cutting peeling sticking head according to the second embodiment.
Figure 21B:
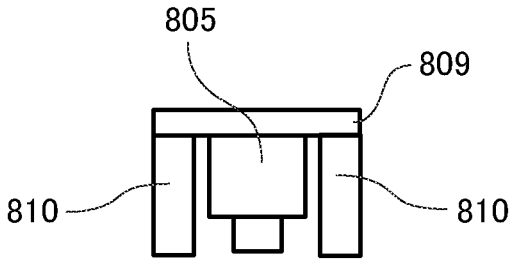
FIG. 21B is a schematic front view of a cutting blade block of the cutting peeling sticking head according to the second embodiment.
Figure 22A:
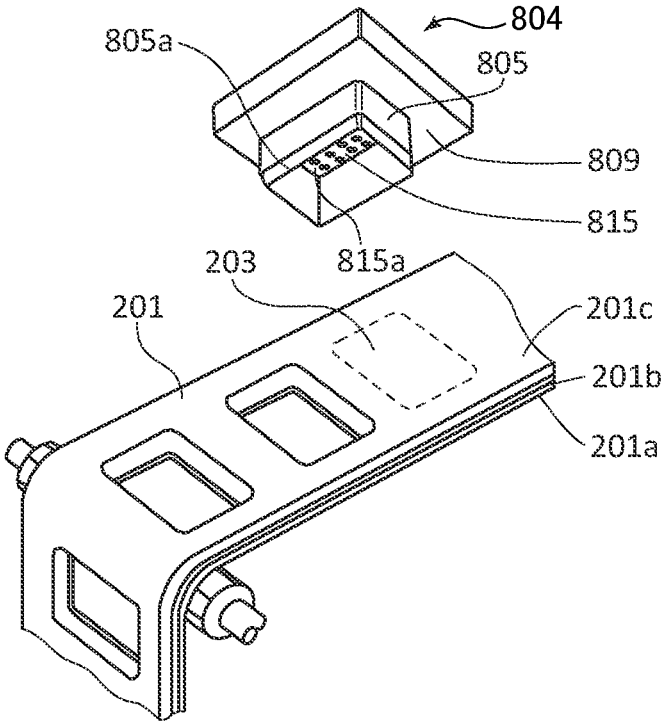
FIG. 22A is a perspective view of a cutting blade of the cutting peeling sticking head and a tape material according to the second embodiment.
Figure 22B:
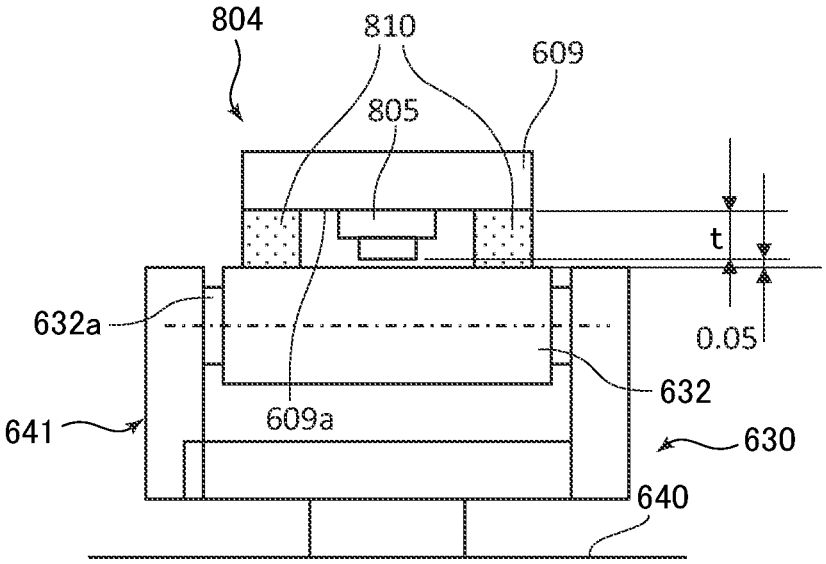
FIG. 22B is a perspective view of the cutting blade of the cutting peeling sticking head and a pressure receiving unit according to the second embodiment.

Next, the configuration of the cutting peeling sticking head 800 according to the second embodiment will be described with reference to FIGS. 21A to 22B. FIG. 21A is a schematic side view of the peeling sticking head according to the second embodiment. FIG. 21B is a schematic front view of the cutting peeling sticking head according to the second embodiment. FIG. 22A is a perspective view of the cutting peeling sticking head and the tape material according to the second embodiment. FIG. 22B is a perspective view of the cutting blade of the cutting peeling sticking head and the pressure receiving unit according to the second embodiment.

As illustrated in FIGS. 21A and 21B, the cutting peeling sticking head 800 includes an attachment 801, and a connecting portion 801*a* of the attachment 801 is fixed to the flange portion 11 (see FIG. 1) disposed on a sixth shaft of the robot arm 10A of the robot apparatus 10. A cutting head 804 is attached to the attachment 801 via attachment plates 802 and 803 integrated with the attachment 801 with bolts 802*a* or the like.

The cutting head 804 is fixed to a support plate 806, and the support plate 806 is supported so as to be movable in the up-down direction indicated by an arrow Z1-Z2 as a result of guide pins 807*a* and 808*a* being inserted in an unillustrated elongated hole defined in the attachment plate 803. Since the elongated hole is longer than the interval between the guide pins 807*a* and 808*a*, the cutting head 804 is relatively movable with respect to the attachment plate 803 by an amount corresponding to the difference.

A bent portion 806*a* formed at an upper end portion of the support plate 806 is inserted in an unillustrated guide hole defined in the attachment plate 803 to protrude on the back surface side of the attachment plate 803, and faces an operant 811*a* that is moved up and down by an air cylinder 811 fixed to the back surface of the attachment plate 803. When this air cylinder 811 is turned on, air is provided thereto via a tube 812, and the air cylinder 811 causes the operant 811*a* to protrude upward in a direction indicated by the arrow Z1. In addition, in an OFF state in which the air is stopped, the operant 811*a* is moved downward indicated by the arrow Z2, and a state in which the air cylinder 811 is pulled back is taken. That is, by switching the air cylinder 811 controlled by a cutting peeling sticking head compliance control portion 712 (see FIG. 20) to the ON state, the bent portion 806*a* of the support plate 806 is pressed upward by the operant 811*a*, and the cutting head 804 is moved upward. Then, the upper position thereof is determined by the abutment between the attachment plate 803 and the bent portion 806*a* of the support plate 806. As a result of this operation, a joined state in which the cutting head 804 is integrated with the attachment 801 and the flange portion 11 of the robot apparatus 10 as a rigid body via the support plate 806 and the attachment plates 803 and 802 is taken.

In addition, in a state in which the air to the air cylinder 811 is OFF, that is, in a state in which the operant 811*a* is pulled back, the support plate 806 moves downward with respect to the attachment plate 803. Further, in the unillustrated elongated hole in the attachment plate 803, the lower guide pin 808*a* is in a released state in which the lower guide pin 808*a* is free within the range of the clearance, and the cutting head 804 is in the ON state of a compliance function in which the cutting head 804 is movable in the vertical direction. As a result of this, the position of the cutting head 804 can be determined by an unillustrated fixing mechanism (for example, a mechanism such as a head locking arm in Japanese Patent Application Laid-Open No. 2022-94451) without putting a load on the robot apparatus 10. The drive of the unillustrated fixing mechanism is controlled by an air cylinder 850 whose drive is controlled by a cutting head locking air control portion 731. That is, the unillustrated fixing mechanism can fix a cutting head pressing plate 809 provided in the cutting head 804 while pressing the cutting head pressing plate 809 against the pressure receiving unit 630 that will be described in detail below by the air cylinder 850.

In addition, as illustrated in FIG. 21B, a cutting blade 805 and a pair of bearer parts 810 are disposed on a lower surface 809*a* (that is, cutting blade attaching surface) of the cutting head pressing plate 809. The bearer parts 810 are attached to the lower surface 809*a* that is the surface to which the cutting blade 805 is attached, and are each formed in a shape slightly taller (projecting downward) than a cutting edge 805*a* of the cutting blade 805. That is, when cutting the sticker part 203 that will be described in detail later, the bearer parts 810 abut the cutting roller 632, and the cutting blade 805 half-cuts the peeling paper 201*a*. To be noted, although a configuration in which the bearer part 810 are provided on the two sides with the cutting blade 805 therebetween has been described in the present embodiment, a configuration in which the bearer part 810 is disposed on only one side may be employed.

In addition, as illustrated in FIG. 22A, the cutting blade 805 is formed in an overall shape set in accordance with the overall shape of the sticker part 203 and serving as a die so as to cut off the sticker part 203 constituted by the adhesive layer 201*b* and the soft material layer 201*c* from the tape material 201 on the whole circumference without cutting the peeling paper 201*a*. Inside the overall shape of the cutting blade 805, a suction attraction block 815 serving as a suction attraction portion is disposed to be capable of being driven with a minute gap between the suction attraction block 815 and the inner wall of the cutting blade 805, and the suction attraction block 815 is configured to be capable of gripping the sticker part 203 by suction attraction. That is, the cutting blade 805 has a hollow shape, and the suction attraction block 815 is driven therein by a drive source such as an unillustrated air cylinder. To be noted, in the case where the shape of the sticker part 203 is a simple quadrangular shape, the cutting blade may be a single straight blade such as a Thomson blade, and configuring the suction attraction block 815 to be driven in a state in which there is a minute gap between the suction attraction block 815 and the cutting blade can be considered also in this case.

In addition, the position of the advancing end (lower end) or the retracting end (upper end) of the suction attraction block 815 can be adjusted with high precision by an adjusting screw or the like. Typically, the distance between the cutting edge 805*a* and a suction attraction surface 815*a* of the suction attraction block 815 at the retracting end (upper end) is a distance at the time of cutting the sticker part 203, and is preferably a value smaller than the thickness of the sticker part 203. In addition, the distance between the cutting edge 805*a* and the suction attraction surface 815*a* at the advancing end (lower end) is a distance at the time of sticking the sticker part 203 to the workpiece, and is preferably very small such that the sticker part 203 can be sufficiently compressed.

To be noted, in the case where the suction attraction block 815 does not need to be driven when sticking the sticker part 203, a part in which the cutting blade 805 and the suction attraction block 815 are integrated may be used. In this case, by employing a configuration in which there is no gap between the inner wall of the cutting blade 805 and the suction attraction block 815, a more sealed state may be generated to stabilize the suction attraction state.

Configuration of Pressure Receiving Unit

Next, the pressure receiving unit 630 that, in the case of cutting the sticker part 203 by the cutting blade 805 described above, receives the pressurizing force of the cutting blade 805 and approaching the cutting blade 805 to cut the sticker part 203 will be described with reference to FIGS. 19 and 22B. As illustrated in FIG. 19, the pressure receiving unit 630 is disposed on the peeling paper 201*a* side of the sticker part 203, and includes a receiving stage 631, a cutting roller 632, a peeling stage 633, and a feeding roller 634. The pressure receiving unit 630 is disposed to be movable in a V1-V2 direction, which is the conveyance direction of the tape material 201 and which is a horizontal direction, by an air cylinder 650 (see FIG. 20) whose drive is controlled by a pressure receiving unit drive control portion 732. That is, the pressure receiving unit 630 is configured to be slidable on a surface on the side of the sticker part 203 opposite to the peeling paper 201*a*. To be noted, the mechanism for moving the pressure receiving unit 630 is not limited to the air cylinder 650, and may be, for example, a mechanism constituted by a servo motor and a ball screw such as a single axis numerical control: NC.

As illustrated in FIG. 22B, the cutting roller 632 of the pressure receiving unit 630 is configured to be rotatable as a result of an axial center 632*a* thereof being rotatably supported by a support arm 641 fixed to and supported by a frame 640 of the pressure receiving unit 630.

In the present embodiment, as will be described in detail later, the cutting peeling sticking head 800 serving as an end effector is moved, by the robot apparatus 10, to a peeling position where the sticker part 203 is cut and peeled off. A mechanical configuration in which the minute gap between the cutting edge 805*a* of the cutting blade 805 and the cutting roller 632 in this state is constant is employed. This gap is set to about a half of the thickness of the peeling paper 201*a*, that is, configured such that the sticker part 203 is cut without fully cutting the peeling paper 201*a*. For managing the minute gap between the cutting edge 805*a* and the cutting roller 632, the bearer parts 810 (see FIG. 21B) provided in the cutting peeling sticking head 800 described above are used. That is, when the pressure receiving unit 630 is moved in the V2 direction that is a horizontal direction in a state in which the cutting blade 805 is biting into the sticker part 203 at the position of the receiving stage 631, the cutting roller 632 abuts and is pressed against the bearer parts 810. At this time, a minute gap between the cutting blade 805 and the cutting roller 632 can be generated easily and with high precision by the height difference between the bearer parts 810 and the cutting blade 805.

Specifically, in the case where the height of the cutting blade 805 is t and the thickness of the peeling paper 201*a* is 0.1 mm, the height of the bearer parts 810 is set to t+0.05 mm. As a result of this, the gap between the cutting edge 805*a* and the cutting roller 632 is 0.05 mm in the state in which the bearer parts 810 are pressed against the cutting roller 632.

In addition, as illustrated in FIG. 19, the pressure receiving unit 630 includes the receiving stage 631 and the peeling stage 633 disposed adjacent to the cutting roller 632. The receiving stage 631 receives the pressurizing force pressing the cutting edge 805*a* of the cutting blade 805. The level difference between the highest point of the cutting roller 632 and the receiving stage 631 is set to, for example, 0.20 mm. In this case, in a state in which the cutting peeling sticking head 800 has been moved to the peeling position described above, an upper surface 631*a* of the receiving stage 631 serves as the pressure receiving surface, and the gap between the cutting edge 805*a* and the upper surface 631*a* of the receiving stage 631 is 0.25 mm. That is, the sticker part 203 is compressed by the cutting blade 805 to the size of this gap. This 0.25 mm is a value set such that the position of the cutting edge 805*a* is slightly away from reaching the peeling paper 201*a*, and the entirety of a sponge serving as the sticker part 203 is compressed together by the suction attraction block 815. That is, this state is set for compressing the sticker part 203 without receiving a reaction force of the cutting load and while minimizing the deformation of the sticker part 203, and for cutting the sticker part 203 while maintaining the compressed state thereof. To be noted, at this time, since the movement of the tape material 201 is stopped as will be described later, the cutting blade 805 and the tape material 201 do not relatively move in the conveyance direction (V1-V2 direction), and the cutting blade 805 only moves in the compressing direction. This suppresses deformation of the sticker part 203 in the conveyance direction.

Further, as a result of sliding the pressure receiving unit 630 in the conveyance direction that is a horizontal direction while maintaining the compressed state of the sticker part 203, the cutting roller 632 and the cutting blade 805 are pressed against each other, and thus the sticker part 203 is cut. To be noted, at this time, the position of the cutting head 804 is maintained by the unillustrated fixing mechanism described above such that the cutting roller 632 rolls while in contact with the bearer parts 810, in other words, such that the cutting head 804 is not displaced by the reaction force of the cutting.

To be noted, in the positional relationship between the highest point of the cutting roller 632 and the upper surface 631*a* of the receiving stage 631, in the case where the level difference therebetween is large, there is a possibility that the sticker part 203 is displaced when the cutting blade 805 pressurizes and compresses the sticker part 203. This can be a cause of inconsistency in the shape of the cut cross-section of the sticker part 203 or inconsistency in the position where the cut sticker part 203 is held by the suction attraction block 815. Further, if the cutting roller 632 is moved in the state in which the sticker part 230 is displaced, the sticker part 203 is deformed greatly, and the sticker part 203 is cut in the deformed state, which leads to inconsistency in the shape of the cut sticker part 203. Therefore, the inconsistency in the shape of the sticker part 203 and the like can be suppressed by setting the level difference between the highest point of the cutting roller 632 and the receiving stage 631 to an appropriate value such as 0.20 mm as described above.

Meanwhile, the peeling stage 633 includes an upper surface 633*a* that receives the tape material 201 from which the sticker part 203 has been cut off in the form in which the sticker part 203 has been cut off, and a leading end portion 633*b* having an acute angle and a function that promotes peeling of the cut sticker part 203. The peeling stage 633 draws the peeling paper 201*a* of the tape material 201 in a Z shape in side view by the feeding roller 634 and the pressing roller 609, and thus bends the peeling paper 201*a* along the leading end portion 633*b* having an acute angle. That is, as a result of being moved in the horizontal direction (V1-V2 direction) by the movement of the pressure receiving unit 630, the peeling stage 633 moves the position where the peeling paper 201*a* is bent, and thus promotes the peeling of the cut sticker part 203 from the peeling paper 201*a*.

Incidentally, when cutting the sticker part 203 by the cutting roller 632 and the cutting blade 805, the cutting blade 805 bites into the peeling paper 201*a* of the tape material 201 to almost a half of the thickness of the peeling paper 201*a*. That is, the adhesive layer 201*b* constituted by a double-sided tape or the like is cut apart by the cutting blade 805, and the cut apart state is maintained until the pressure receiving unit 630 moves in the V2 direction and thus the sticker part 203 moves to the leading end portion 633*b* of the peeling stage 633. As a result of this, the reattachment of the adhesive layer 201*b* of the double-sided tape or the like can be suppressed at the cut apart position.

In addition, the level difference between the highest point of the cutting roller 632 and the upper surface 633*a* of the peeling stage 633 is also preferably as small as possible to maintain the state in which the cutting edge 804*a* of the cutting blade 805 is biting into the tape material 201. To be noted, in the present embodiment, a case where the receiving stage 631, the cutting roller 632, and the peeling stage 633 are integrally provided in the pressure receiving unit 630 has been described. However, depending on the material of the tape material 201, the sticker part 203 can be cut and peeled off approximately simultaneously by drawing the tape material 201 along the outer circumference of the cutting roller 632 without using the peeling stage 633, and the peeling stage 633 is not necessarily needed.

Configuration of Control System of Tape Material Control Apparatus

Here, the configuration of the control system of the tape material control apparatus 2000 will be described with reference to FIG. 20. FIG. 20 is a block diagram illustrating a control system of the tape material control apparatus 2000 in the second embodiment. As illustrated in FIG. 20, the sticker material supply apparatus 600 includes the supply portion rotation control portion 721 that drives the motor 601A to control the rotational speed of the supply portion 601 (supply speed of the tape material 201). Further, the sticker material supply apparatus 600 includes the dancer roller control roller control portion 722 serving as a first rotary driving portion that drives the motor 602A to control the rotational speed of the dancer roller control roller 602 (feeding speed of the tape material 201). Further, the sticker material supply apparatus 600 includes the waste material feeding roller control portion 723 serving as a second rotary driving portion that drives the motor 612A to control the rotational speed of the waste material feeding roller 607 (conveyance speed of the waste material 204). In addition, the sticker material supply apparatus 600 includes the cutting head locking air control portion 731 that drives the air cylinder 850 to position and fix the cutting head 804 of the cutting peeling sticking head 800 with respect to the pressure receiving unit 630. Further, the sticker material supply apparatus 600 includes the pressure receiving unit drive control portion 732 that drives the air cylinder 650 to control the movement of the pressure receiving unit 630 in the horizontal direction. These motors and air cylinders are each simultaneously and independently controlled, and thus driving of the rollers, the pressure receiving unit 630, and the like can be controlled in a desired manner. In addition, the sticker material supply apparatus 600 includes the slack detection sensor Sn1, the dancer roller position detection sensor Sn2, the dancer roller abnormality detection sensor Sn3, and the sticker material leading end detection sensor Sn4 described above in connection with the system controller 500.

In addition, the cutting peeling sticking head 800 is provided with a suction attraction control portion 710 that turns the suction attraction mechanism 713 of the suction attraction block 815 on and off. In addition, the cutting peeling sticking head 800 is provided with a suction attraction block driving air control portion 711 that controls an air cylinder 714 that drives the suction attraction block 815 in the up-down direction. In addition, the cutting peeling sticking head 800 is provided with the cutting peeling sticking head compliance control portion 712 that controls the air cylinder 811 for controlling a compliance function of the cutting peeling sticking head 800. The cutting peeling sticking head compliance control portion 712 is configured to control the ON/OFF of the air cylinder 811 such that the movement of the cutting head 804 in the cutting peeling sticking head 800 is enabled and disabled in certain conditions. To be noted, the detailed configuration, control, compliance function, and the like of the cutting peeling sticking head 800 are substantially the same as those described in Japanese Patent Application Laid-Open No. 2022-094451, and therefore the details thereof will be omitted in the present specification for the sake of simplification of the description.

Sticker Part Supply Operation

Figure 23:
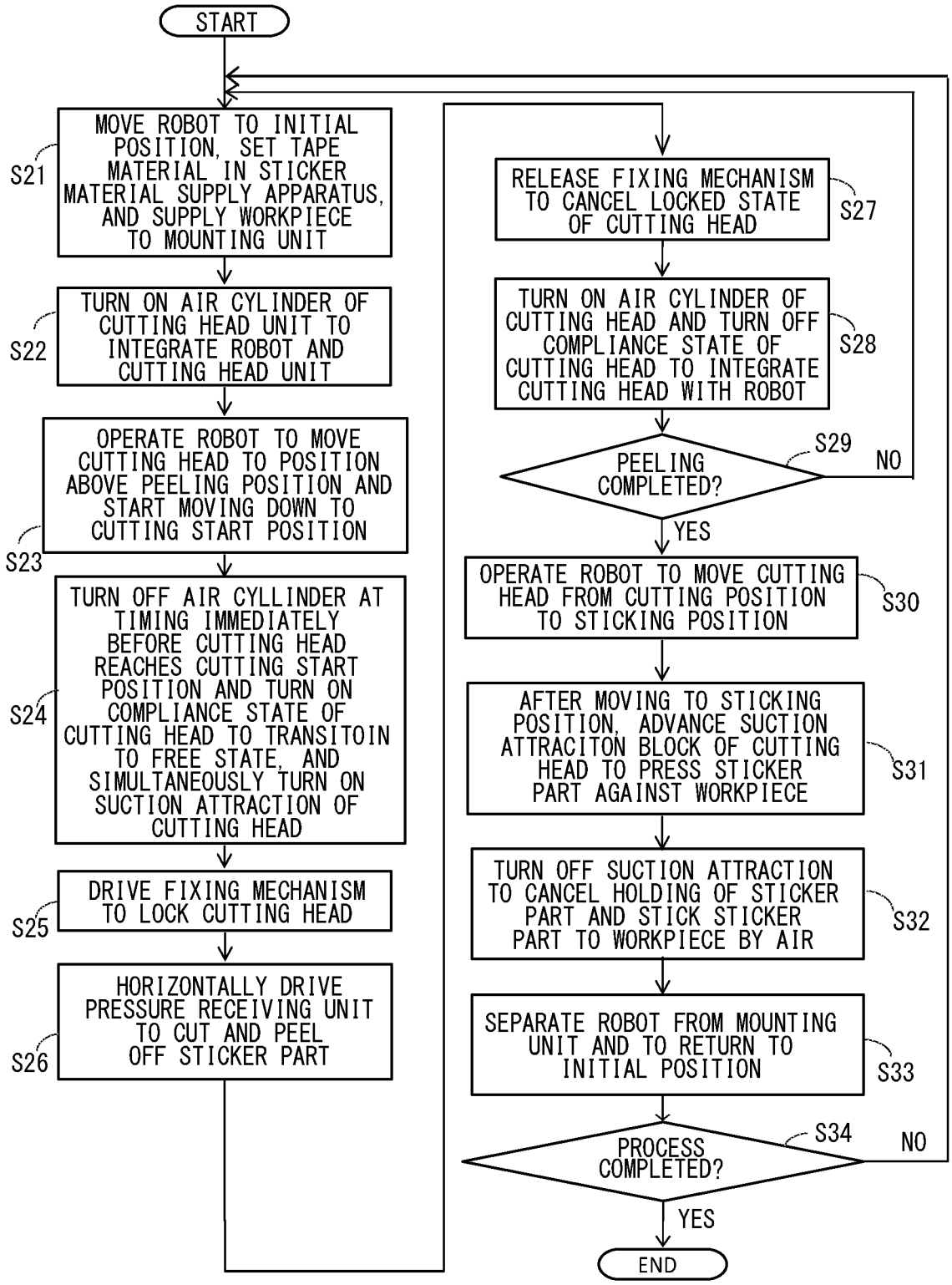
FIG. 23 is a flowchart illustrating a sticker part supply step according to the second embodiment.

Next, the operation of supplying the sticker part 203 to the robot apparatus 10 from the sticker material supply apparatus 600 in the tape material control apparatus 2000 will be described with reference to FIG. 23. FIG. 23 is a flowchart illustrating a sticker part supply process according to the second embodiment.

Preparation Step

Before starting the operation of supplying the sticker part 203 from the sticker material supply apparatus 600 to the robot apparatus 10, preparation of the sticker material supply apparatus 600 is performed as a preparation step. First, the tape material 201 needs to be manually drawn to the supply path in the sticker material supply apparatus 600. That is, the tape material 201 from which the sticker part 203 has not been cut off into a product shape is set in the sticker material supply apparatus 600 in the initial stage.

At this time, a case where the position of the dancer roller 604 is not appropriate when the tape material 201 is simply set can be considered. In this case, the dancer roller 604 is moved to a predetermined position by rotating the waste material feeding roller 607 or the dancer roller control roller 602. For example, in the case where the position of the dancer roller 604 is below a predetermined position (position within a predetermined range from the original position), the waste material feeding roller 607 is rotated to a position where the position of the dancer roller 604 is detected by the dancer roller position detection sensor Sn2. Thus, the dancer roller 604 is moved up. Conversely, in the case where the position of the dancer roller 604 is above a predetermined position (position within a predetermined range from the original position), the dancer roller control roller 602 is rotated to a position where the position of the dancer roller 604 is detected by the dancer roller position detection sensor Sn2. Thus, the dancer roller 604 is moved down.

Further, the tape material 201 fed from the supply portion 601 is pulled by the rotation of the dancer roller control roller 602. Therefore, the supply portion 601 is rotated until the slack amount of the tape material 201 fed from the supply portion 601 being a predetermined slack amount is detected by the slack detection sensor Sn1. Then, the rotation of the supply portion 601 is stopped on the basis of the detection result. To be noted, after this, the system controller 500 controls the rotation of the supply portion 601 such that the tape material 201 between the supply portion 601 and the dancer roller control roller 602 is always maintained at a constant slack amount.

When the preparation of the sticker material supply apparatus 600 is completed as a result of the preparation step described above, the sticker material supply apparatus 600 takes the initial state. The control of the supply operation (supply process) by the tape material control apparatus 2000 is started in accordance with the flowchart illustrated in FIG. 23. To be noted, the following control is control (processing) basically performed solely by the system controller 500, and therefore in the following description, description indicating that the operation is performed by the system controller 500 will be omitted.

Supply Operation

Robot Moving Step

When the system controller 500 starts the control of the present supply operation, first, in step S21, the robot apparatus 10 is controlled to move to the initial position. In addition, in the sticker material supply apparatus 600, a portion of the sticker part 203 that is not cut in the tape material 201 is conveyed to and set in a peeling position where the cutting and peeling are performed. Then, a workpiece is supplied to and set in an unillustrated mounting unit.

Next, in step S22, the air cylinder 811 in the cutting head 804 of the cutting peeling sticking head 800 is turned on, and thus the flange portion 11 of the robot arm 10A and the cutting head 804 are integrated.

Next, in step S23 the robot apparatus 10 is operated to move the cutting peeling sticking head 800 provided at a distal end of the robot apparatus 10 to a position above the peeling position of the sticker part 203. Further, the robot apparatus 10 is operated to start moving down the cutting peeling sticking head 800 to a cutting start position where the cutting of the sticker part 203 by the cutting blade 805 is started, that is, to a position where the cutting blade 805 comes into contact with the sticker part 203.

Then, in step S24, at a timing immediately before the cutting head 804 reaches the cutting start position, the air cylinder 811 is turned off, and the compliance state of the cutting head 804 is turned on. That is, the cutting head 804 is switched to a state of being free in the up-down direction. In addition, the air cylinder 714 is turned on, and the suction attraction of the suction attraction block 815 of the cutting head 804 is turned on. In addition, in step S25, the unillustrated fixing mechanism (locking arm or the like) is driven by driving the air cylinder 850, and thus the cutting head 804 is locked to be relatively unmovable in the up-down direction with respect to the pressure receiving unit 630. As a result of this, the cutting blade 805 is pressed against the receiving stage 631 and bites into the portion serving as the sticker part 203 in the tape material 201. In addition, at this time, the dancer roller control roller 602 and the waste material feeding roller 607 are stopped, and a state in which the tape material 201 does not move is maintained in a state in which a predetermined tension is applied to the tape material 201 by the dancer roller 604. As a result of the tension of the tape material 201 at this time being maintained at a constant value by the dancer roller 604, the extension and contraction of the tape material 201 are stabilized, and a desired shape can be stably obtained for the cut shape of the sticker part 203.

Peeling Starting Step of Sticker Part

Next, in step S26, the pressure receiving unit 630 is driven in the V2 direction in the horizontal direction, and the sticker part 203 is cut off and peeled off from the tape material 201. Specifically, as a result of the cutting peeling sticking head 800 moving to the cutting peeling position, the entirety of the outer circumference of the sticker part 203 is compressed by the receiving stage 631 and the cutting blade 805, and the entirety of the inside of the sticker part 203 is compressed by the receiving stage 631 and the suction attraction block 815. Then, the pressure receiving unit 630 is moved in the horizontal direction (V2 direction) in a state in which the cutting peeling sticking head 800 is stopped. As a result of this, the highest point of the cutting roller 632 moves in the horizontal direction while generating a pressurizing force on the cutting edge 805*a* of the cutting blade 805 by point contact, and thus the sticker part 203 is cut. In addition, at the same time, the suction attraction block 815 sucks air on the inside of the cutting blade 805, and thus the sticker part 203 is attracted to and gripped by the suction attraction block 815 by suction attraction. At this time, in the sticker part 203, air easily passes through the soft material layer 201*c* because the soft material layer 201*c* is formed from sponge or the like, but since the adhesive layer 201*b* constituted by a double-sided tape or the like does not easily pass air therethrough, the suction attraction of the sticker part 203 is reinforced. Therefore, the cut sticker part 203 is attracted to and gripped by the suction attraction block 815 by suction attraction while maintaining the compressed state from before the cutting. Further, the leading end portion 633*b* of the peeling stage 633 bends the tape material 201 and moves the bent position in the horizontal direction, and thus promotes the peeling of the sticker part 203 from the tape material 201.

When the movement of the pressure receiving unit 630 in the V2 direction in the horizontal direction is finished, in step S27, the air cylinder 850 is turned off to release the unillustrated fixing mechanism (locking arm or the like), and thus the locked state of the cutting head 804 is cancelled. In addition, in step S28, the air cylinder 811 is turned on and the compliance state of the cutting head 804 is turned off, that is, the cutting head 804 is integrated with the flange portion 11 of the robot arm 10A.

Here, if the peeling of the sticker part 203 is not completed for some reason, that is, in the case where the result of step S29 is NO, the process returns to step S21 described above, the control described above is repeated until the peeling of the sticker part 203 is completed. Then, in the case where it has been determined that the peeling of the sticker part 203 has been completed, that is, in the case where the result of step S29 is YES, the process proceeds to the next step (for example, the sticker part sticking step described later).

Initial State Transition Step

In the case where the peeling of the sticker part 203 is completed as described above, that is, in the case where the result of step S29 is YES, the process proceeds to the sticking step (S30 to S33) of the sticker part 203 described below, and at this time, the sticker material supply apparatus 600 transitions to the initial state in parallel (initial state transition step). Specifically, the pressure receiving unit 630 is moved in the V1 direction to return to the original position (initial position), and then the waste material feeding roller 607 is rotated by a predetermined amount to feed the tape material 201 by a certain pitch. At this time, similarly to the preparation step, the waste material feeding roller 607 or the dancer roller control roller 602 is rotated to move the dancer roller 604 to a predetermined position. The position of the dancer roller 604 should be higher than a predetermined position (position within a predetermined range from the original position) as a result of feeding the tape material 201 by the certain pitch. Therefore, the dancer roller 604 is moved down by rotating the dancer roller control roller 602 to a position where the position of the dancer roller 604 is detected by the dancer roller position detection sensor Sn2.

Slack Amount Adjusting Step

Further, when the tape material 201 is fed by the certain pitch as described above, the sticker material supply apparatus 600 adjusts the slack amount of the tape material 201 (slack amount adjusting step). That is, the tape material 201 fed from the supply portion 601 is pulled by the rotation of the dancer roller control roller 602. Then, as described above, the slack amount of the tape material 201 fed from the supply portion 601 is detected by the slack detection sensor Sn1, and the supply portion 601 is rotated such that a constant slack amount is maintained all the time.

In addition, in the series of operations, the slack amount of the tape material 201 fed from the supply portion 601 is always maintained at a predetermined amount or more. That is, the slack detection sensor Sn1 always detects the slack amount, and when the slack amount becomes a predetermined amount of less, the supply portion 601 is rotated to generate the slack of the predetermined amount or more, and thus a state in which the tape material 201 is slack is maintained all the time. That is, the rotation and stoppage of the supply portion 601 are controlled only in accordance with the slack amount of the tape material 201 independently from the rotation operation of each roller.

Sticker Part Sticking Step

When the sticker part 203 is attracted to the suction attraction block 815 of the cutting peeling sticking head 800 by suction attraction as described above, the cutting peeling sticking head 800 is moved to a position above the workpiece by changing the posture of the robot arm 10A by operating the robot apparatus 10 in step S30. Next, in step S31, for example, a feature point of the workpiece is detected by the on-hand camera 115 to detect the sticking position of the sticker part 203, and thus the cutting peeling sticking head 800 is moved to a sticking position on the workpiece. Then, the suction attraction block 815 is advanced to compress the sticker part 203 between the suction attraction block 815 and the workpiece. In step S32, by turning off the suction attraction of the suction attraction block 815 or discharging air in a reverse direction in this state, the holding of the sticker part 203 is cancelled, and thus the sticker part 203 is stuck to the workpiece. As a result of this, in step S33, a workpiece to which the sticker part 203 is stuck can be manufactured as a product. Then, the cutting peeling sticking head 800 is returned to the initial position by operating the robot apparatus 10 to change the posture of the robot arm 10A. To be noted, after this, the process returns to the robot moving step (S21) described above to proceed to the cutting peeling operation of the next sticker part 203, which corresponds to NO of step S34. Alternatively, in the case where it has been determined that all the manufacturing steps have been finished, that is, in the case where the result of step S34 is YES, all the work steps by the tape material control apparatus 2000 described above are finished.

Summary of Second Embodiment

As described above, according to the tape material control apparatus 2000 of the second embodiment, the system controller 500 individually controls the rotation of each of the dancer roller control roller 602 and the waste material feeding roller 607. That is, the feeding speed of the tape material 201 by the dancer roller control roller 602 and the conveyance speed of the waste material 204 by the waste material feeding roller 607 are individually controlled. Further, according to this control, the sticker part 203 is supplied from the sticker material supply apparatus 600 to the robot apparatus 10 while reducing the movement distance of the cutting peeling sticking head 800. Therefore, the sticker part 203 can be gripped by the cutting peeling sticking head 800 while suppressing the movement of the cutting peeling sticking head 800 to a minimum value. Therefore, the cutting position is less limited than in the case of cutting and peeling off the sticker part 203 from the tape material 201 while moving the cutting peeling sticking head 800 (that is, the cutting blade 805), and thus the versatility as manufacturing equipment can be improved.

In addition, according to the tape material control apparatus 2000 according to the second embodiment, the sticker part 203 is attracted and gripped by suction attraction by the suction attraction block 815 while cutting the sticker part 203 by the cutting blade 805. As a result of this, the cutting blade 805 does not need to be moved away after cutting the sticker part 203, and the cutting edge of the cutting blade 805 is present at an interface of the cut adhesive layer 201*b* from the cutting to the peeling. Therefore, occurrence of reattachment of the adhesive layer 201*b* after the cutting blade 805 can be suppressed, thus occurrence of a peeling failure of the sticker part 203 can be suppressed, and the reliability of the peeling can be improved.

Further, according to the tape material control apparatus 2000 according to the second embodiment, a height difference is set between the cutting blade 805 and the bearer parts 810, and the bearer parts 810 are configured to directly press the cutting roller 632. As a result of this, the gap between the cutting blade 805 and the cutting roller 632 can be managed with high precision. In addition, in such a configuration, the sticker part 203 of any thickness can be used by just setting the height of the bearer parts 810, which improves the versatility.

Particularly, if the type of the sticker part 203 is different, the thickness of the peeling paper 201*a* being different and the thickness, compression rate, and/or the like of the sponge being different can be considered. However, in the second embodiment, the gap between the cutting blade 805 and the cutting roller 632 can be managed to be constant regardless of the physical properties of the sticker part 203 to be used. As a result of this, stable cutting can be performed regardless of the physical properties of the sticker. In addition, if the type of the sticker part 203 is different, the thickness, compression rate, and/or the like thereof are different, but the compression rate of the sticker part 203 at the time of cutting and peeling can be adjusted by adjusting the position of the retracting end of the suction attraction block 815 in accordance with the physical properties of the sticker part 203 to be used. As a result of this, optimum peeling of the sticker part 203 matching the physical properties of the sticker can be achieved.

In addition, at the time of cutting and peeling the sticker part 203, the receiving stage 631 of the pressure receiving unit 630, the cutting roller 632, and the peeling stage 633 are integrally driven, and the cutting blade 805 is fixed so as not to move. As a result of this, in the cutting and peeling of the sticker part 203, the shape of the sticker part 203 can be maintained, and the precision of the sticker part 203 as a part can be improved. In addition, also when sticking the sticker part 203 to the workpiece, since the shape of the sticker part 203 is maintained, the sticking precision can be improved.

POSSIBILITY OF OTHER EMBODIMENTS

In the first embodiment described above, a case where the peeling sticking head 100 is not moved, that is the robot arm 10A is not moved while winding up the sticker part 202 has been described. However, the peeling sticking head 100 may be moved while winding up the sticker part 202. Particularly, if the movement distance at this time is smaller than the length of the sticker part 202, the size of the tape material control apparatus 1000 can be reduced.

In addition, in the first embodiment, a case where the rotational speed of the winding roller 104 is adjusted in accordance with the type of the sticker part 202, particularly the thickness, compression rate, and/or the like of the sticker part 202 has been described. However, the configuration is not limited to this, and a configuration in which the rotational speed of the winding roller 104 is fixed and the conveyance speed of the tape material 201 by the peeling paper feeding roller 307 and the dancer roller control roller 302 is adjusted may be employed. That is, if the winding speed of the winding roller 104 and the conveyance speed of the tape material 201 match, occurrence of loose winding and tight winding can be suppressed.

In addition, in the first embodiment, a case where the sticker part 202 is spirally wound up as a result of the winding roller 104 rotating while moving in the axial direction has been described. However, the configuration is not limited to this, and a configuration in which the sticker part is wound up by one rotation of a winding roller having a large outer diameter and not moving in the axial direction may be employed. Further, in the case of spirally winding the sticker part around the winding roller 104, for example, the sticker part may be wound around in multiple layers such as two or three layers.

In addition, in the first and second embodiments, a case where a tension is applied to the tape material 201 by the dancer roller 304 or 604 has been described. However, the configuration is not limited to this, and any configuration may be employed as long as a tension can be applied to the tape material 201. For example, movement of one or both of the dancer roller control roller 302 or 602 and the peeling paper feeding roller 307 or the waste material feeding roller 607 may be controlled, and the tension may be applied by extending or contracting the path of these. In addition, the tension may be applied by using the speed difference between the dancer roller control roller 302 or 602 and the peeling paper feeding roller 307 or the waste material feeding roller 607.

In addition, in the first and second embodiments, a case where one type of tape material (sticker part) is supplied from one supply portion 301 or 601 has been described. However, the configuration is not limited to this, and for example, a configuration in which tape materials of a plurality of types different in at least one of width, thickness, material, and the like can be supplied to the robot apparatus 10 in parallel may be employed to improve the versatility in terms of products to be manufactured. Further, in the case of enabling supplying the tape materials to the robot apparatus 10 in parallel, the lengths of the sticker parts to be supplied may be different.

In addition, in the first and second embodiments, a case where a reel around which the tape material is wound is set in the supply portion 301 or 601 has been described, but the configuration is not limited to this, and a configuration in which the tape material is supplied from a supply apparatus disposed on the further upstream side may be employed.

The present disclosure is not limited to the embodiments described above, and the embodiments may be modified in many ways within the technical concept of the present disclosure. For example, at least two of the plurality of embodiments and plurality of modification examples described above may be combined. In addition, the effects described in the present embodiment are merely enumeration of the most preferable effects that can be obtained from the embodiments of the present disclosure, and the effects of the embodiments of the present disclosure are not limited to those described in the embodiments.

Although a case where the robot body is a robot of a vertically articulated robot has been described in the embodiments described above, the configuration is not limited to this. The robot body may be, for example, a horizontally articulated robot, a parallel link robot, or an orthogonal robot. In addition, the embodiments described above can be applied to machines capable of automatically performing extension, contraction, bending, vertical movement, horizontal movement, turning, or a composite operation of these on the basis of information in a storage device provided in the control apparatus.

According to the present invention, the versatility can be improved.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-072835, filed Apr. 27, 2023, and Japanese Patent Application No. 2024-045553, filed Mar. 21, 2024 which are hereby incorporated by reference herein in their entirety.

What is claimed is:

1. A tape material control apparatus comprising:

a supply apparatus including:

a supply portion configured to supply a tape material including a peeling member and a sticker member capable of being peeled off from the peeling member;

a first roller configured to feed the tape material supplied from the supply portion to a peeling position where the sticker member is peeled off from the peeling member;

a first rotary driving portion configured to rotate the first roller;

a second roller configured to convey the peeling member from which the sticker member has been peeled off at the peeling position;

a second rotary driving portion configured to rotate the second roller;

a dancer roller movably supported so as to increase and decrease a length of a passage path of the tape material present between the first roller and the second roller and configured to apply a tension to the tape material at the peeling position; and a first detection portion configured to detect a position of the dancer roller;

a robot apparatus including:

a third roller around which the sticker member peeled off at the peeling position is windable; and an end effector including:

a third rotary driving portion configured to rotate the third roller; and a robot body to which the end effector is attached; and a controller configured to individually control a feeding speed of the tape material by the first rotary driving portion, a conveyance speed of the peeling member by the second rotary driving portion, and a winding speed of the sticker member by the third rotary driving portion so that the sticker member is supplied from the supply apparatus to the robot apparatus in a state in which a length of the sticker member to be wound around the third roller is smaller than a movement distance of the end effector, wherein in accordance with a detection result of the first detection portion, the controller is configured to adjust the feeding speed of the tape material controlled by the first rotary driving portion with respect to the conveyance speed of the peeling member controlled by the second rotary driving portion.

2. The tape material control apparatus according to claim 1, wherein the controller is configured to wind the sticker member around the third roller in a state in which a posture of the robot body is maintained.

3. The tape material control apparatus according to claim 1, wherein in accordance with a type of the sticker member, the controller is configured to adjust a rotational speed of the third roller controlled by the third rotary driving portion.

4. The tape material control apparatus according to claim 2, wherein in accordance with a thickness of the sticker member, the controller is configured to adjust a rotational speed of the third roller controlled by the third rotary driving portion.

5. The tape material control apparatus according to claim 2, wherein in accordance with a compression rate of the sticker member, the controller is configured to adjust a rotational speed of the third roller controlled by the third rotary driving portion.

6. The tape material control apparatus according to claim 1, wherein the end effector includes an axial direction moving portion configured to move the third roller in an axial direction of the third roller, and wherein the controller is configured to move the third roller in the axial direction by the axial direction moving portion in synchronization with rotation of the third roller by the third rotary driving portion, and thus spirally wind the sticker member around the third roller.

7. The tape material control apparatus according to claim 1, wherein the supply apparatus includes a second detection portion configured to detect a state in which the dancer roller is positioned at an abnormal position out of a normal movement range, and wherein the controller is configured to stop the supply apparatus and the robot apparatus in a case where the dancer roller at the abnormal position is detected by the second detection portion.

8. The tape material control apparatus according to claim 1, wherein the supply apparatus includes a third detection portion configured to detect a slack amount of the tape material between the supply portion and the first roller, and wherein in accordance with the slack amount of the tape material detected by the third detection portion, the controller is configured to adjust a supply speed of the tape material from the supply portion with respect to the feeding speed of the tape material controlled by the first rotary driving portion.

9. The tape material control apparatus according to claim 1, wherein the supply apparatus includes a cutting portion configured to cut the sticker member to a length for supply to the robot apparatus without cutting the peeling member.

10. The tape material control apparatus according to claim 9, wherein the end effector includes a first gripping portion capable of gripping and positioning the sticker member with respect to the third roller, wherein the supply apparatus includes a fourth detection portion configured to detect arrival at a start position of a leading end of the sticker member that has not been peeled off from the tape material, the start position being a position where peeling of the sticker member at the peeling position is started, and wherein in a case where the fourth detection portion has detected the arrival at the start position of the leading end of the sticker member, the controller is configured to stop conveyance of the tape material by the first rotary driving portion and the second rotary driving portion, grips the leading end of the sticker member by the first gripping portion, and starts supply of the sticker member from the supply apparatus to the robot apparatus.

11. The tape material control apparatus according to claim 10, wherein the end effector includes a second gripping portion capable of gripping the sticker member, and wherein in a case where a trailing end of the sticker member whose leading end is gripped by the first gripping portion and which has been cut by the cutting portion is conveyed to a trailing end gripping position where the second gripping portion is capable of gripping the trailing end, the controller is configured to stop the conveyance of the tape material by the first rotary driving portion and the second rotary driving portion, grips the trailing end of the sticker member by the second gripping portion, and ends supply of the sticker member from the supply apparatus to the robot apparatus.

12. The tape material control apparatus according to claim 11, wherein the end effector includes a fourth roller configured to come into contact with the sticker member stretched between the third roller and the second gripping portion, and wherein the controller is configured to stop the winding of the sticker member around the third roller by the third rotary driving portion, turns the end effector by driving the robot body about the fourth roller, thus peels off part of the sticker member extending from the third roller to the fourth roller from the peeling member, peels off part of the sticker member extending from the fourth roller to the second gripping portion by moving the end effector away from the supply apparatus in a state in which the trailing end of the sticker member is gripped by the second gripping portion, and then ends the supply of the sticker member from the supply apparatus to the robot apparatus.

* * * * *